US007318811B1

(12) United States Patent
Corbishley

(10) Patent No.: US 7,318,811 B1
(45) Date of Patent: Jan. 15, 2008

(54) VIBRATING BODY JEWELRY DEVICE

(76) Inventor: Charles Corbishley, Box 137 Props Hobby Lake Rd., Brackney, PA (US) 18812

( * ) Notice: Subject to any disclaimer, the term of this patent is extended or adjusted under 35 U.S.C. 154(b) by 498 days.

(21) Appl. No.: 10/342,953

(22) Filed: Jan. 15, 2003

Related U.S. Application Data

(63) Continuation-in-part of application No. 10/162,424, filed on Jun. 3, 2002, now abandoned.

(60) Provisional application No. 60/294,581, filed on Jun. 1, 2001.

(51) Int. Cl.
*A61H 1/00* (2006.01)

(52) U.S. Cl. ..... 601/70; 601/73

(58) Field of Classification Search ..... 601/46, 601/69, 70–75, 78–81
See application file for complete search history.

(56) References Cited

U.S. PATENT DOCUMENTS

| | | | | |
|---|---|---|---|---|
| 6,102,876 | A | 8/2000 | Winger | |
| 6,244,073 | B1 | 6/2001 | Kaping, Jr. | |
| D447,715 | S | 9/2001 | Wilkinson | |
| D450,614 | S | 11/2001 | Wilkinson | |
| 6,382,815 | B1 | 5/2002 | Klearman et al. | |
| 6,419,649 | B1 | 7/2002 | Klein | |
| 6,490,885 | B1 * | 12/2002 | Wilkinson | 63/1.11 |
| 6,572,569 | B2 * | 6/2003 | Klein | 601/70 |
| 6,675,613 | B2 | 1/2004 | Ashton | |
| 2001/0047664 | A1 * | 12/2001 | Andrews et al. | 63/31 |
| 2002/0041159 | A1 | 4/2002 | Kaping, Jr. | |
| 2003/0035994 | A1 | 2/2003 | Zavilenski | |
| 2003/0142512 | A1 * | 7/2003 | Klearman et al. | 362/571 |
| 2003/0181784 | A1 | 9/2003 | Klein | |
| 2003/0181835 | A1 | 9/2003 | Klein | |
| 2003/0192344 | A1 | 10/2003 | Ashton | |
| 2003/0230111 | A1 | 12/2003 | Northington | |
| 2004/0020241 | A1 | 2/2004 | Boiadjian | |

FOREIGN PATENT DOCUMENTS

| | | |
|---|---|---|
| WO | WO 01/76685 A2 | 10/2001 |

* cited by examiner

*Primary Examiner*—Michael A. Brown
(74) *Attorney, Agent, or Firm*—Charles A. Wilkinson; Clinton H. Wilkinson

(57) ABSTRACT

A vibratory body jewelry item for attachment to the tongue or other body parts comprising one or motor and battery casings and a post connecting said casings having various improvements including a gripping member to facilitate opening and closing of said casings, an longer lasting battery and motor combination, a kit including extra batteries and alternative casing sizes, and a band or suction cup for attaching said item to other unpierced body parts.

34 Claims, 13 Drawing Sheets

Fig. 16
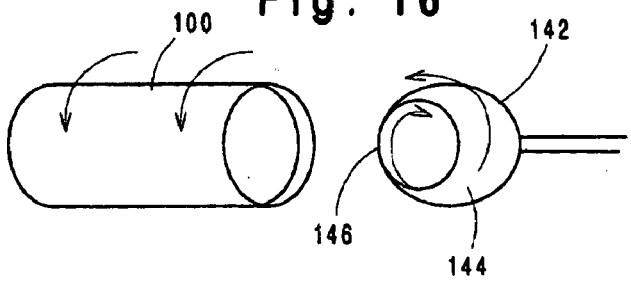
Fig. 17
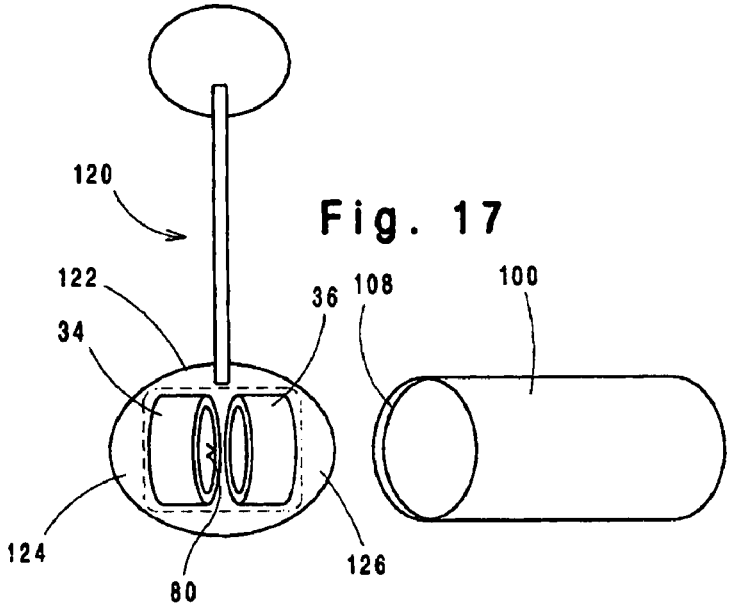
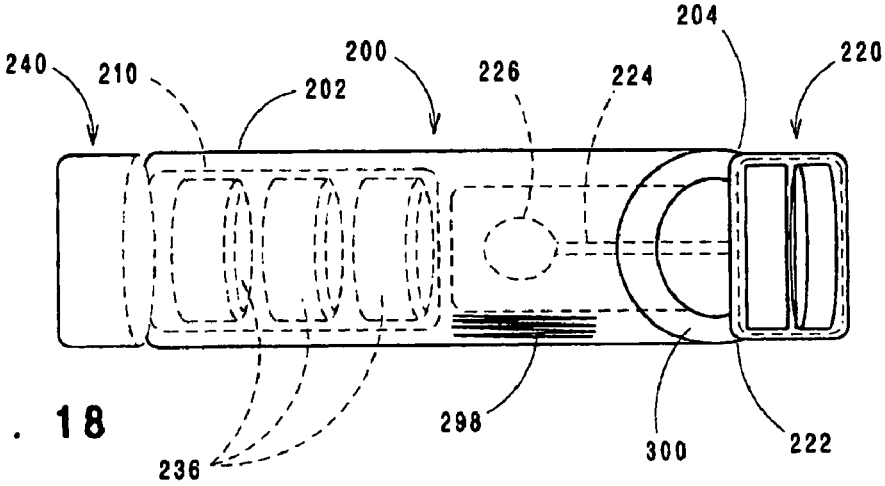
Fig. 18

Fig. 25
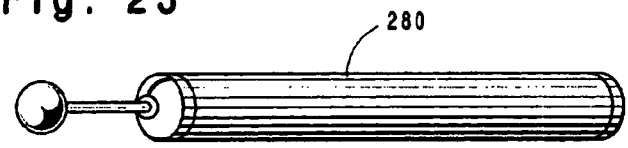
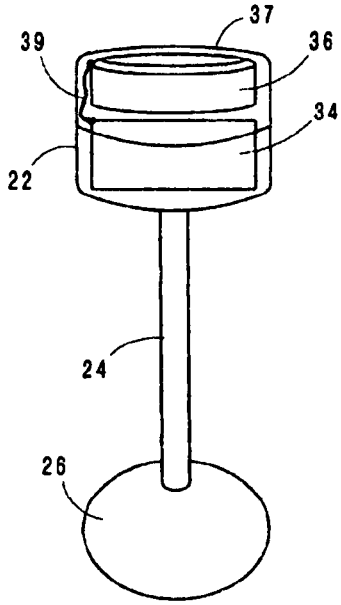
Fig. 24
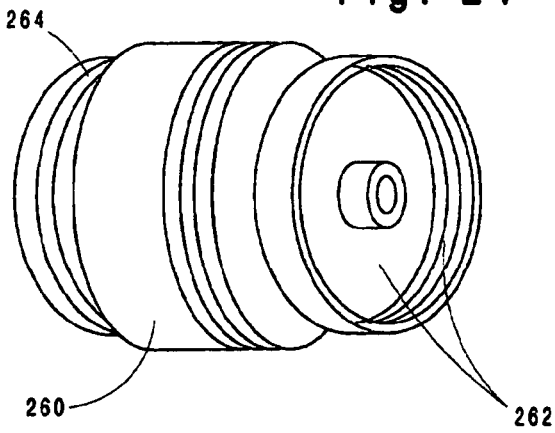
Fig. 28
Fig. 26
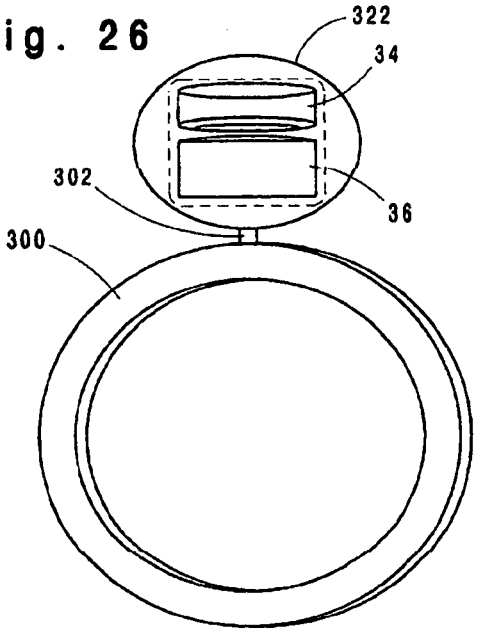
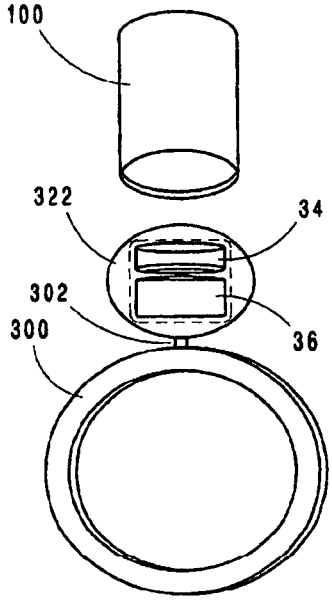
Fig. 27

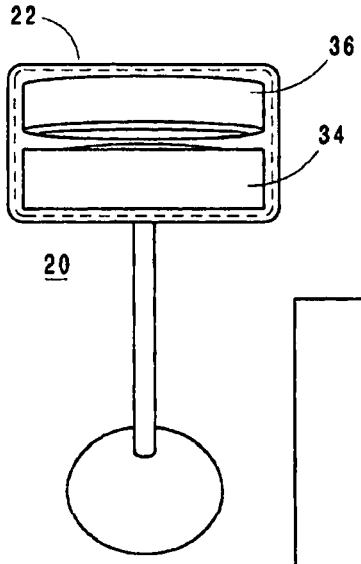
Fig. 29
Fig. 29a
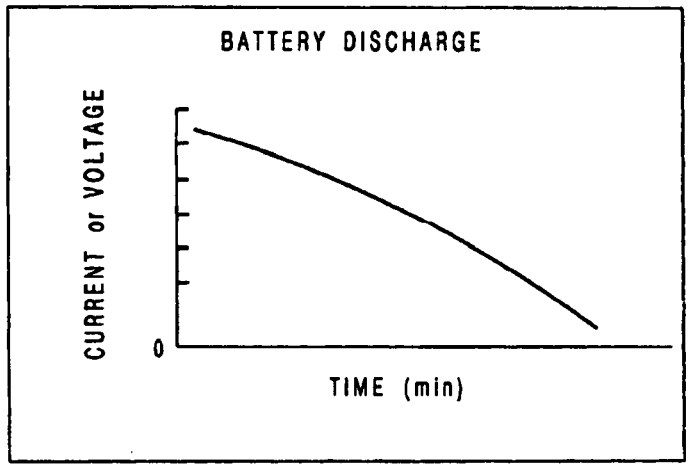
Fig. 29b
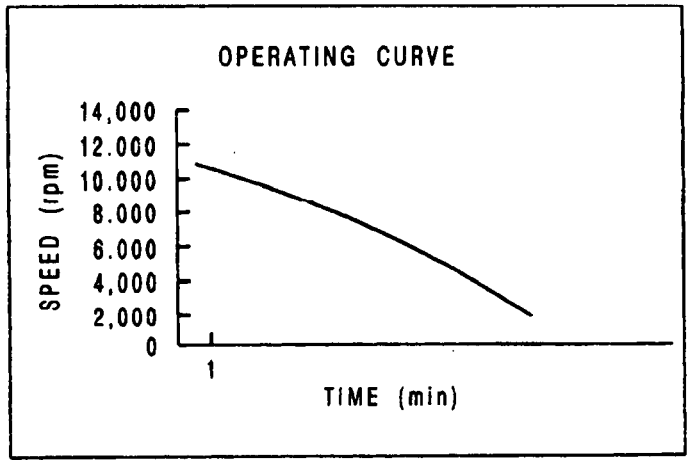

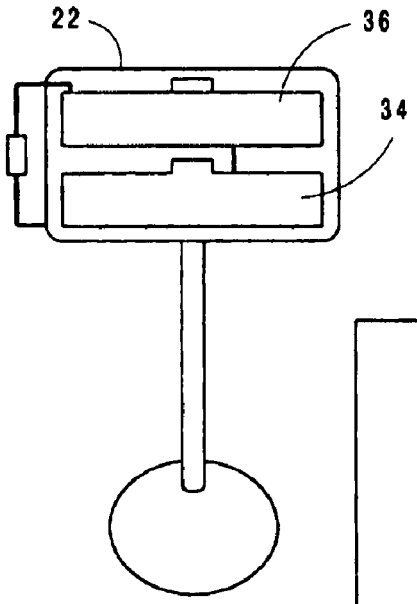
Fig. 30
Fig. 30a
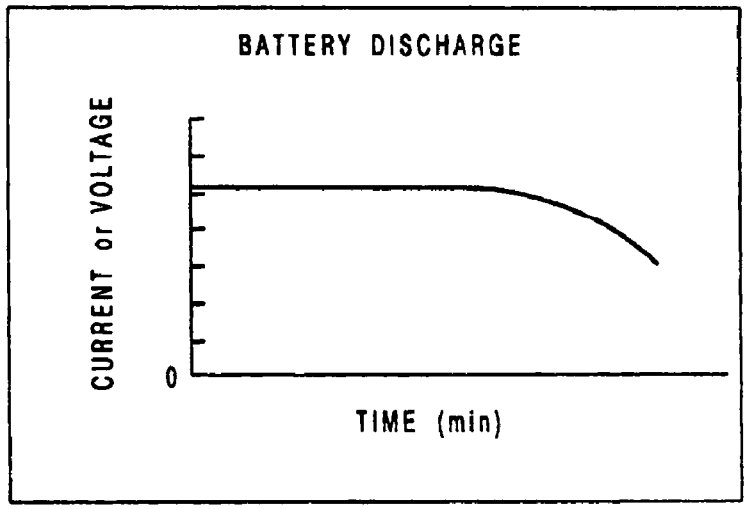
Fig. 30b
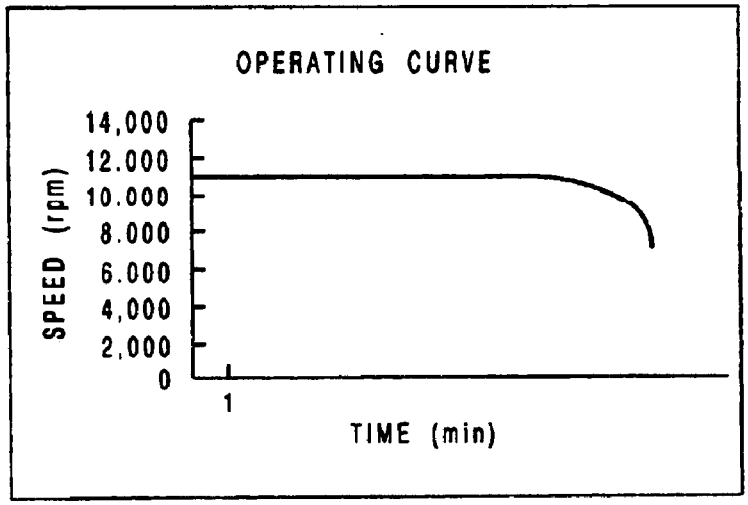

VIBRATING BODY JEWELRY DEVICE

CROSS REFERENCE TO RELATED APPLICATION

This application is a continuation-in-part of U.S. Utility application Ser. No. 10/162,424, filed Jun. 3, 2002 now abandoned, which claims the benefit of U.S. Provisional Application Ser. No. 60/294,581, filed Jun. 1, 2001.

BACKGROUND OF THE INVENTION

1. Field of the Invention

The present invention relates to body jewelry and body piercing in general, and more particularly to body jewelry incorporating a vibrational motor giving the body jewelry device vibrating capabilities.

2. Preliminary Discussion

Body piercing has been practiced in various cultures or religions for centuries. A variety of reasons for piercing one's body have been theorized, such as being a sign of bravery, part of a religious ceremony, as a right of passage of affiliation, for sexual enhancement, or simply as a sign of non-conformity or for decorative or ornamental purposes. In modern society, until recently, except for ear piercing in females, body piercing was considered a fringe activity. However, in recent years body piercing has become more accepted and mainstream, possibly due to the availability of safer and more hygienic piercing techniques and hypoallergenic jewelry. In addition, many musicians, members of the fashion world, movie stars and other celebrities now have piercings, which also contributed to the increased popularity of such practice by making it appear more fashionable and trendy. Multiple piercings have also become much more common. For example, it is not unusual today for females to have several piercings in the earlobe and rim of the ear. Belly button and eyebrow piercing is also quite common, and piercing has also become much more common in males. Other less common but still typically pierced areas may include the tongue, side of the nostrils, or even the nasal septum. Piercing of the nipples, tongue or sex organs is also practiced by some, mainly for sexual stimulation or pleasure.

3. Description of Related Art

As body piercing has increased in popularity, so have the number of different styles and designs of body jewelry to be inserted in such pierced areas. Such jewelry may be simply ornamental, but increasingly is augmented with one or more additional functional characteristics or features. Until recently, the concept of a small jewelry item worn on a pierced area of the body and having a vibrating capability apparently was not known, or at least was not technologically practical, primarily due to the large size of available motors and batteries. Recently, however, the present inventor has become aware of several recent patent disclosures directed to vibrating body jewelry devices.

U.S. Pat. No. 6,382,815 issued to J. D. Klearman et al. on May 7, 2002, entitled "ENERGIZED BODY JEWELRY," discloses several alternative embodiments of a vibrating jewelry device to be worn on pierced areas such as the tongue. The reference numerals in the following refer to the references in the Klearman et al. patent to facilitate review thereof, but can be ignored if a copy of such reference is not immediately available. In one embodiment of Klearman, the device includes housing 13, post 18, and retainer ball 20, with a battery 22 and electromagnetic motor 24 having an eccentric rotor 44 enclosed in the housing 13. Housing 13 is closed on its ends by threaded end caps 14 and 16, having slots 30 and 32 for insertion of a screwdriver-type implement to facilitate turning of the cap on the threads. The negative end of battery 22 is facing motor 24 so that the negative terminal presses against negative body contact 36, held in place by shim 34, and also contacts negative motor lead wire 38 leading to motor 24. End cap 14 contacts the positive end of the battery 22 when threaded into the housing 13, while positive motor lead wire 40 extends from motor 24 through post 18, ending at positive contact 56. When retainer ball 20 is threaded to post 18, positive motor lead wire 40 contacts positive contact 56 in ball 20, thereby completing the circuit and activating the motor. Therefore, retainer ball 20 serves as the activation or actuating means for the device. In one alternative embodiment, a second battery is provided in the retainer ball, while in another alternative embodiment both batteries are provided in the retainer ball. Klearman et al. also teaches that the motor may be powered by an external power source provided in a necklace, as well as an elastic band that can be wrapped around the device to secure such device to the tongue of a user not having a pierced tongue. The use of a secondary post extending through the tongue with the device resting on the upper surface of the tongue is also disclosed.

U.S. Pat. No. 6,419,649 issued to E. A. Klein on Jul. 16, 2002, entitled "Erotic Stimulation Device," also teaches several embodiments of a vibrating jewelry device, one of which is a battery powered electric vibrator that can be attached to the user's tongue. In one embodiment, a motor housing 11 and a battery holder 12 are connected by a post 18. Vibrator motor 14, which motor is of a type wherein the vibration is generated by the spinning of an unbalanced weight or armature 15, is secured in motor housing 11, while battery 13 is contained in battery holder 12, with its ground terminal in electrical contact with such holder. Insulator pad 21 is situated in holder 12 on the end nearest the post 18, and insulated conductor core 22 in post 18 conducts electricity from the battery non-ground terminal to the motor. Post 18 acts as the actuating means for the motor, so that power is provided to the motor when the electrical contacts in post 18 contact the battery and motor contacts, so that slightly unscrewing post 18 causes the power to be turned off. The vibration motor used by Klein is of a type developed for use in silent pagers and has a length of approximately 10 mm, with an eccentric weight adding 4 mm to the total length, and a diameter of about 5.5 mm, and preferably is less than 20 mm in length and 8 mm in width or diameter. In an alternative embodiment, a snap socket and tab arrangement is used to hold the vibrator housing and battery holder together on the same end of post 18, with a retaining ball 26 situated on the opposite end of the post. In such embodiment, battery 13 rests against battery contact 30 on the inside of housing 11b, so that in essence the connection between the post 18 and vibrator housing is direct, rather than indirect as in the previous embodiment. In yet another embodiment, the vibrator housing is securable to the front or tip of the tongue mostly by suction in a reduced pressure device but also by friction ribs 34.

U.S. Patent Application 2001/0047664 filed by J. T. Andrews et al. and published on Dec. 6, 2001, entitled "Vibrating, Body-Piercing Jewelry," teaches another body jewelry device that can be worn on various parts of the body, including a pierced tongue. Such item is generally comprised of a housing, post, and retaining member, with a vibrating motor unit and battery secured in the housing. In one embodiment, housing 20 is comprised of two similarly sized sections 30 and 32 which are threadably secured together, with a rubber O-ring used to prevent leakage between the threads in a normal manner, with second section 32 threadably secured to post 22, and with retaining ball 24 secured on the opposite end of the post. As best shown in FIG. 2 of Andrews, vibrating motor 40 is positioned on top of battery 34 in the housing, with cushioned barrier 44 positioned between the motor and battery. An aperture in barrier 44 is provided for receiving positive node 52 of the motor unit 40. Threaded post 26 acts as the actuator for activating the vibrating motor unit 40, so that when post 26 is turned inwardly on the threads into housing 20, battery 34 is urged upwardly and presses against positive node 52 of motor unit 40, extending through the aperture in barrier 44, creating a contact and allowing current to pass from the battery to the motor. In another embodiment, retaining ball 24 is replaced by a clasp which is used to hold other items, such as dangling chains, rings, and the like, while in a third embodiment a clamping device is provided so that the jewelry item can be attached to non-pierced surfaces of the body. Andrews also contemplates that the jewelry can be disposable, and that the device can be actuated by tightening the threads of the housing.

U.S. Patent Application No. 2002/0041159 filed by D. J. Kapling, Jr. and published on Apr. 11, 2002, entitled "Tongue Jewelry With Electrically Energizable Component," discloses a tongue jewelry item comprised of a housing having an electrically energizable cap 121 holding at least one illuminating element, preferably a light emitting diode ("LED"). Underneath the translucent top housing portion 134 is a post housing portion 136 in which batteries 129 and 132 are secured. Such housing is integrally connected to post 116, which is threadably secured to cap 118. FIG. 4 illustrates an alternative embodiment wherein the electrically energizable component includes a vibrator and not an LED.

While each of the above references generally teach a vibratory body jewelry device, various problems are associated with use of each of such devices. Such problems include moisture leakage between the threads of the housing, an unacceptably short battery life and therefore short motor run time, and the large size and clumsy shape of the housings necessitated by the types of batteries and motors used. Leakage of moisture such as saliva into the housing between the threads of the housing might occur if there is a lot of play or room between the threads or if the housing sections are not securely tightened together. However, if the housings were made smaller, it would be extremely difficult to properly manually align and then tighten the threads due to the small size of the device, which makes the housing sections hard to manually grip and rotate. Moisture leakage into the housing is extremely undesirable because it may cause damage to the internal motor and battery, or cause the device to short circuit. In addition, it is desirable to prevent any materials inside the housing from leaking into the mouth of the wearer, which obviously could be a health hazard. Therefore, there is a need for a suitable means to facilitate tightening of the threads of the sections of the housings to ensure that the device is moisture tight, and preferably which would not require any notching or the like in the outer surface of the housing which might irritate the mouth of a user or acquaintance.

Another drawback found in one or more of the disclosed prior art devices is that the cylindrical vibrating motors utilized vibrate too fast or strongly so that they are uncomfortable in the mouth of the user. The shape of the cylindrical housings, which is essentially necessitated by the use of such configured motors, also contributes to the uncomfortableness of such prior art devices in the mouth of the user, which housing are also large and bulky. In addition, while some of such prior art devices may provide adequate vibration power for a short time period, such power rapidly diminishes over time so that the power is adequate only for a short time when the battery is new. There is also therefore a need for an improved motor assembly wherein the vibrational power remains constant for a longer operational period or run time without any noticeable loss of vibration speed. In addition, in known devices the means for establishing a contact between the battery or power source and motor is such that often proper contact cannot be reliably established, so that the motor will not always activate properly. There is also therefore a need for an improved contact means between the motor and battery in such assemblies.

The present inventor has conceived of several ingenious improvements that are not anticipated by the prior art. One such improvement is the provision of a detachable gripping member which grips the outer surface of the cap portion of the jewelry casing so that such cap can be more easily threaded to the main body portion of the casing. The use of a gripping member also allows the threads to have a much tighter tolerance than would otherwise be possible, further decreasing the chances of leakage between the threads occurring. The gripping member can be in several forms, but preferably is comprised of a handle portion and a cap gripping portion which is contoured to fit tightly around or frictionally grip the sides of the cap portion of the casing, so that it can be used to secure the casing cap more tightly to the main body of the casing.

The present inventor has also conceived of an arrangement for increasing the run or operational time of the vibrating motor. In such arrangement, a battery having flatter discharge characteristics than other similar batteries is used. Such battery is preferably, although not necessarily, used in combination with a motor that has been modified so that its resistance has been slightly increased. As a result, the vibrating motor is slowed slightly, but not so much that the slowing is noticeable to a user. In fact, it has been found that the physiological detection of vibration in the tongue in particular is not as acute as it is, for example, in the fingers so that the wearer of a vibrating jewelry item in the tongue is not aware of a significant decrease in speed or vibrations per minute or second allowing vibrational speed or vibrations per time period to be exchanged for longer vibrational periods. In addition, a battery, preferably a silver oxide Energizer® brand battery, which are known to be capable of maintaining a constant power factor for longer periods than other batteries, is used so that the motor can maintain a constant vibration speed for a longer time period than previously available with barely any noticeable change in vibrational effect by the user. The increased resistance significantly increases the life span of the battery, yet the speed of the vibrating motor is not decreased to a readily or physiologically noticeable degree. The present inventor has also provided, in one embodiment, a unique and improved electrical contact arrangement wherein a contact is situated in the top of the casing so that the battery can be placed in an inverted position with respect to the motor, which allows the casing to have a more comfortable and pleasing shape. In addition, a dimpled dome switch arrangement is provided on the top of the motor to facilitate contact with the battery, therefore ensuring that a reliable contact between the motor and battery is established. It has been found that due to the small size of both the battery and the vibrating motor or motor for the vibrator it is peculiarly difficult to obtain good electrical contact between the battery and the motor and the present inventor has found a very simple yet elegant and effective way to improve such contact in an environment where contact between the motor and the battery must be regularly made and broken, unlike the usual environments for which such small vibrating motors and small flat batteries are primarily manufactured. Also provided is an improved means for securing the device to an unpierced tongue or other body part.

Overall, the foregoing improvements result in a more reliable body jewelry device not only having a longer operational life but also having a more comfortable reduced size and weight but which can still be easily handled or manipulated. In another embodiment, the device may be provided with casings in one or more sizes so that more than one battery or a single larger battery can alternatively be used with the device. Other arrangements, such as the provision of a novel external power source so that the device can be used as a vibrating wand, arrangements for packaging the jewelry device, and other related embodiments further increase the versatility of the present device.

OBJECTS OF THE INVENTION

It is therefore a primary object of the invention to provide a jewelry device that can be secured through a piercing in the tongue or other body part and which has a vibrating motor and power source, usually a battery, encased therein.

It is a further object of the invention to provide a vibrating body jewelry device comprised of a casing having a main body portion and a threadably attached cap portion wherein a detachable gripping member is provided to facilitate tightening of the cap portion to the main body portion of the casing, thereby reducing the opportunity for moisture to leak into the casing.

It is a still further object of the invention to provide a vibrating jewelry device wherein the threads securing the casing cap portion to the main body portion of the casing are provided with a tighter than normal thread tolerance, thereby further reducing the opportunity for moisture to leak between the threads.

It is a still further object of the invention to provide a vibrating jewelry device having a motor and battery assembly wherein the usual vibration speed of the motor has been slightly decreased, and wherein the battery used to operate the motor has a flat discharge characteristic, thereby improving both the performance and longevity or run time of the device.

It is a still further object of the invention to provide a body jewelry device wherein the battery casings are provided in more than one size so that different numbers of batteries or batteries having different sizes and strengths can alternatively be used with the device.

It is a still further object of the invention to provide a vibrating body jewelry device having a unique dimpled dome switch arrangement attached to the motor to facilitate more reliable contact between the motor and battery.

It is a still further object of the invention to provide a decorative vibrating body jewelry device that is barbell shaped and is more comfortable to wear than previous vibrating jewelry devices.

It is a still further object of the invention to provide a kit containing, but not limited to, the vibrating jewelry device of the invention, several extra batteries, at least two different sized battery casings, a gripping member, and a band for alternatively securing the device to non-pierced areas of the body.

It is a still further object of the invention to provide a means for that alternatively securing the vibrating body jewelry device to non-pierced areas of the body.

Still other objects and advantages of the invention will become clear upon review of the following detailed description in conjunction with the appended drawings.

SUMMARY OF THE INVENTION

A vibrating decorative jewelry device is provided for attachment to a pierced tongue or other pierced or unpierced body part to provide a vibratory sensation to the wearer or to another party coming in contact with the device. In the several principal embodiments, the device is generally comprised of a preferably surgical steel primary or main casing, a post connected on one end to the primary casing, and a second casing, retaining ball, stud or other end piece connected to the other end of the post. In one embodiment, a vibratory motor and battery assembly are situated in the primary casing such that vibrations generated by the motor are transferred to the casing and ultimately are felt by a user, such device typically being temporarily secured to the tongue of the user. A gripping member is provided to aid in threadably securing the cap portion of the casing to the main body portion, which gripping member is constructed and contoured so that it frictionally grips the sides of the casing cap. To improve the vibratory performance and longevity of the device, the inventor also provides a battery and motor assembly wherein the resistance of the motor has been slightly increased so that the speed of vibration of the motor is somewhat slowed, but only by an amount that is substantially or almost imperceptible to the user. Such modification is preferably provided in combination with the use of a battery having a flat discharge characteristic. This combination results in a more reliable vibrating jewelry device having a significantly longer lasting run time or operational period. The inventor has also provided an improved contact arrangement between the motor and battery comprised of a dome switch assembly situated on the motor. The dome switch assembly preferably includes a further raised portion or dimple on its end, and in addition the central portion of the dimple is preferably inverted so that when the battery contacts and presses against the top of the dome switch, the inverted portion is pressed inwardly until it touches the motor contact, thereby activating the motor. The device may also be provided with one or more alternative battery casings having different sizes so that the device can be easily used with a single battery, more than one battery, or different sized batteries, thereby allowing the user to better regulate the speed and power or longevity of the motor run time. An elastic or rigid band may also be provided so that the device is attachable to unpierced parts of the body. This can also be achieved by means of a suction cup instead of a band. Also shown is a way to double the overall amount of vibration by using a second vibrating casing on the lower portion of the post. In summary, the improvements offered in the present device result in a greatly improved vibrating body jewelry device that is safer, more comfortable with more stimulation and more versatile than previously known devices.

BRIEF DESCRIPTION OF THE DRAWINGS

FIG. 16 is a side view of the gripping member of the invention but having a spherical shape as shown in FIG. 13 and including arrows showing the direction of rotation of the gripping member and casing cap to activate the motor in the casing.

FIG. 17 illustrates the gripping member of the invention used in connection with a side-by-side motor and battery assembly having or contained within a spherical casing.

FIG. 18 illustrates another embodiment of the gripping member and body jewelry device assembled in kit form.

FIG. 24 illustrates a threaded insert used with an alternative embodiment of the invention.

FIG. 25 is an isometric view of the body jewelry item of the invention attached to a battery pack using the insert shown in FIG. 24.

FIG. 26 is a side view of another alternative embodiment of the invention wherein the vibratory casing is secured to an elastic or metal band.

FIG. 27 is a side view of the invention further illustrating the gripping member situated above said casing in position to be moved into contact therewith.

FIG. 28 is a side elevation view of another alternative embodiment of the invention having an inverted battery configuration.

FIG. 29 is a diagrammatic view of the operating characteristics of prior art electrical circuit for the vibrating tongue jewelry device of the invention including two charts indicating the battery discharge characteristics plus an operating curve.

FIG. 30 is a diagrammatic view of the an improved electrical circuit for the vibrating tongue jewelry device of the invention in which a combination of the use of a flat discharge battery is combined with a resistance in the power circuit designed to decrease the speed of the vibrational motor for 10 to 15% in order to overall attain as much as a 50% increase in vibrational operation with one battery.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
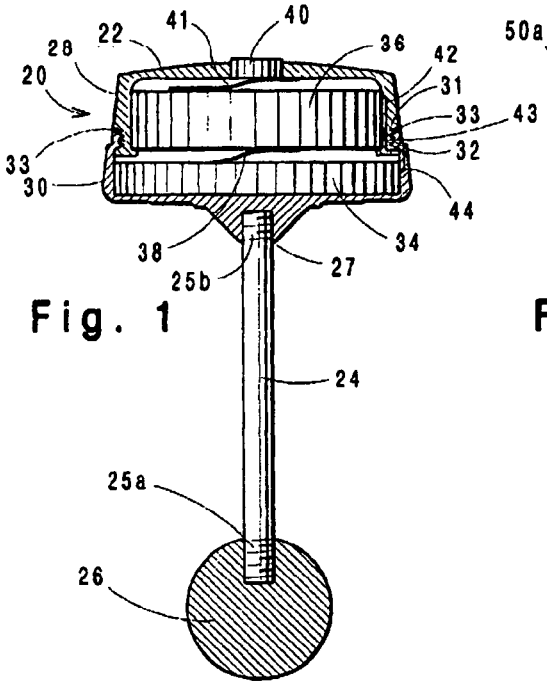
FIG. 1 is a sectional side elevation view of a first embodiment of the invention.

Referring to FIG. 1, there is shown in section a first embodiment of the vibrating body jewelry device 20 of the invention. Device 20 is generally comprised of a casing 22 having a hollow interior area, or volumns large enough to hold a vibrating motor assembly of the type described below, a post or barbell 24 attached on one end to casing 22 and which typically will be secured through a pierced area of the body, and a ball or stud 26 attached to the other end of post 24 to hold the jewelry device in place in such pierced area. When secured to a pierced tongue, casing 22 will be situated on the top side of the tongue, with post 24 extending through the tongue and held in place by stud 26 situated on the bottom side of the tongue and secured to the post 24 by threads 25*a*. The post 24 is attached to casing 22 by threaded end 25*b*. In the embodiment shown in FIG. 1, casing 22 is comprised of top or upper casing section 28 and bottom or lower casing section 30, which sections are threadably secured together by top and bottom male and female threads 31 and 32, respectively. A gasket or sealing ring 33, preferably made from a resilient rubber or plastic material, is situated adjacent male threads 31 and is squeezed between sections of the upper and lower casing sections when the threads are tightened in the usual manner to prevent leakage of saliva or other fluids into or out of the casing.

Vibratory mechanism or device 34, typically a motor having an unbalanced armature, fits snugly into lower section 30 of casing 22 so that it preferably directly engages the inner walls of the casing where it is frictionally held in place. Optionally, an adhesive may be used to aid in securing motor 34 in the casing. Power source 36, typically a chemically driven electric current generating device such as a battery, is generally situated in upper section 28 of casing 22 so that when the upper and lower sections are joined, battery 36 is positioned more or less adjacent to and on top of motor 34. The arrangement of motor 34 and battery 36 may also be reversed in casing 22, or they may be arranged so that they are side-by-side in the casing as shown in FIG. 17. In any case, however, as indicated above motor 34 is preferably flush against the inner wall of the casing 22 so that vibrations from the motor when activated are transferred directly to the casing and ultimately transmitted to the user. Pressure sensitive spring contact 38 is secured to the top side of motor 34 and establishes a contact between the motor 34 and battery 36 when the motor and battery are brought together. As detailed below, depending upon the arrangement used to actuate or activate motor 34, such contact may be constant in some versions, or if motor 34 and battery 36 are urged towards each other as part of the means for activating the motor, contact between the motor 34 and battery 36 will be usually established by spring contact 38 at such time. See also the discussion directed to the provision of a dimpled dome switch on the motor below with respect to FIGS. 11*a*-11*c*, which disclose another preferred means for ensuring proper contact between the motor and battery.

Several alternative arrangements for activating and de-activating motor 34 are possible, three of which are shown generally in FIG. 1. A first possible means is the use of a pressure sensitive switch, indicated by the numeral 40 and shown generally in the form of a hand or finger operated button situated preferably on the top section 28 of casing 22, although switch 40 could also be located in other areas of top section 28 or lower section 30 of the casing. Pressure spring 41 is attached to and extends downwardly from switch 40 so that when the switch is depressed, spring 41 contacts battery 36, completing a circuit and activating motor 34. The circuit includes microwire 42 extending down the side of the casing or the battery, which provides a connection from switch 40 down the inner wall of casing 22 and connecting to either the positive or negative terminal of battery 36 and then to motor 34. Bottom microwire connection 44 is provided for opposite connection to the battery. A simple circuit of a type well known to those skilled in the art is thereby provided, wherein depressing switch 40 either establishes or breaks the circuit. It will be understood that means to maintain the circuit in either an activated or unactivated state once the switch is pressed or activated will also be provided.

Another arrangement for activating and de-activating motor 34 can be accomplished through the tightening and loosening of threads 31 and 32 used to secure sections 28 and 30 of casing 22 together. In such arrangement, battery 36 is brought into contact with a pressure spring 38, dome switch, or into direct contact or by another means with motor 34 when threads 31 and 32 are tightened, or a thread circuit connection 43 may be provided in casing 22 so that when threads 31 and 32 are tightened, a circuit connection is established, thereby activating motor 34. Still another possible means for activating and deactivating the device 20 is through post 24. As shown in FIG. 1, one end of post 24 is threadably secured in receiving area 27 located on the underside of lower section 30 of casing 22 on threads 25. In such embodiment, receiving area 27 would open into lower section 30, so that when threads 25 are turned inwardly or tightened on receiving area 27, post 24 will be urged inwardly or upwardly as shown in FIG. 1, eventually pressing against motor 34 and causing the motor to also move upwardly in the casing until pressure spring 38 or dome switch as discussed below of motor 34 contacts battery 36, thereby establishing a contact and actuating motor 34.

Figure 2:
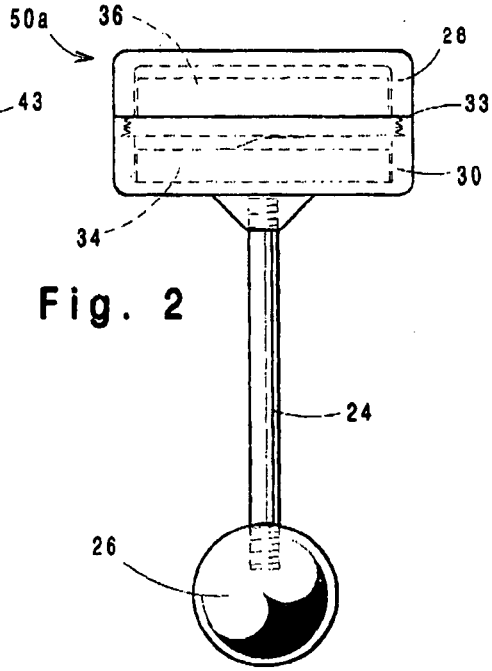
FIG. 2 is a side elevation view of the invention as shown in FIG. 1 having a first alternative casing configuration.
Figure 3:
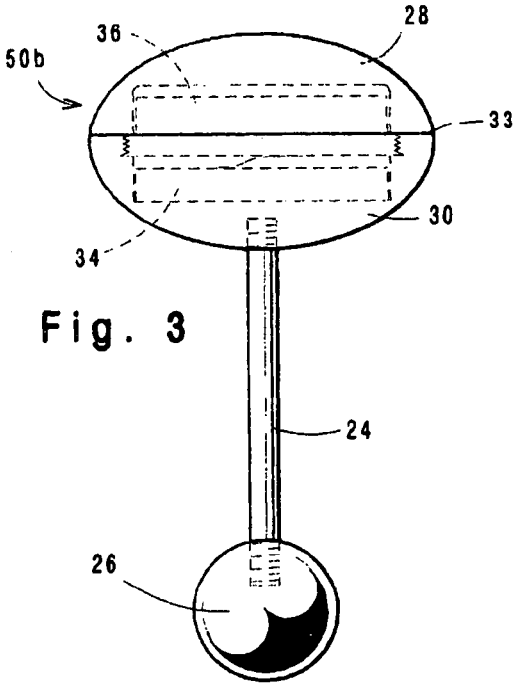
FIG. 3 is a side elevation view of the invention as shown in FIG. 1 having a second alternative casing configuration.
Figure 4:
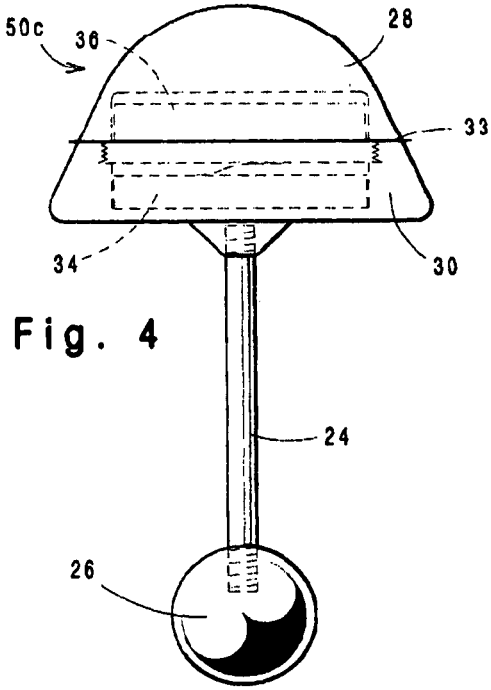
FIG. 4 is a side elevation view of the invention as shown in FIG. 1 having a third alternative casing configuration.

FIGS. 2-4 illustrate alternative embodiments of the invention which illustrate that the shape of casing 22 can be modified to suite the user. In FIG. 2, a more rectangular shaped casing 50*a* is provided. In FIG. 3, a spherically shaped casing 50*b* is provided, while in FIG. 4*a* triangular shaped casing 50*c* is provided, shown in dotted lines. By providing casings having different shapes or designs, a slightly different vibrational sensation is provided by jewelry device 20, some of which may be more preferred by a particular user than others, depending upon the desired stimulatory or vibrational effect. For example, the rectangular casing shown in FIG. 2 may be desired by those who wish to have the casing situated as close to the surface of the tongue as possible. However, a spherical shape (FIG. 3) may be preferred by those desiring a continual or smooth casing surface, which may be less irritating to the skin, particularly if worn on the tongue, while the triangular shape (FIG. 4) may be preferred if it is desired that the vibration be directed to a small surface or tip of the casing. Other features, such as ridges or undulations on the outside surface of the casing 22, may be added to create further unique sensations. Post 24 may also be bent or angled forwardly or rearwardly or otherwise as desired, again enabling the user to experiment or experience different stimulatory effects depending on the desired experience, or even simply depending upon the design preferences of the user.

Figure 5:
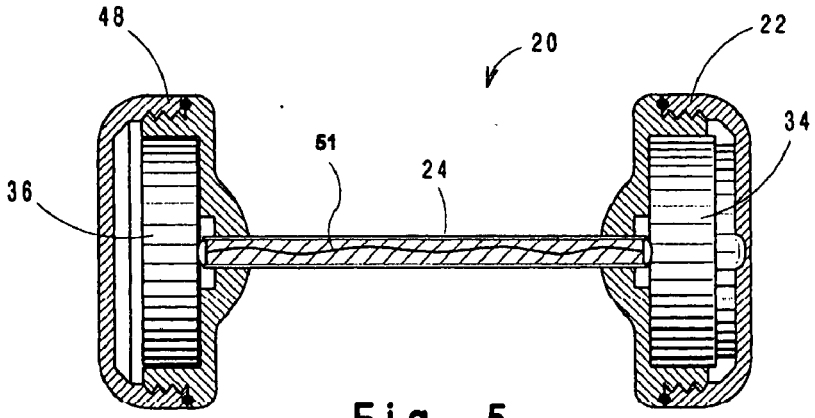
FIG. 5 illustrates an alternative embodiment wherein the motor and battery are situated in separate casings.
Figure 6:
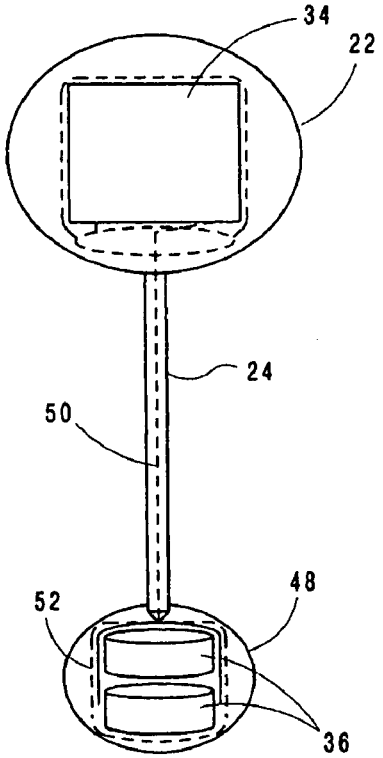
FIG. 6 is a side elevation view similar to FIG. 5 but having a spherical shape and encasing a pair of batteries.
Figure 7:
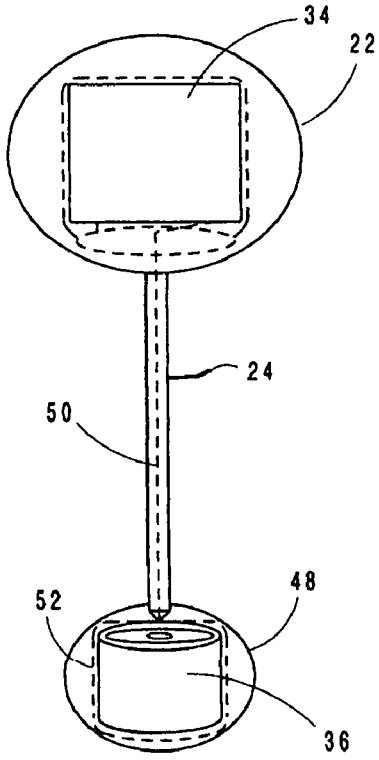
FIG. 7 is a side elevation view of the invention as shown in FIG. 6 with a single battery.

As illustrated in the sectional view in FIG. 5 as well as in FIGS. 6-7, device 20 could also be arranged with motor 34 in casing 22 but with battery 36 in a second casing 48 threadly attached to the opposite end of post 24, the second casing 48 essentially replacing ball or stud 26 shown in FIG. 1. In such embodiment, a passageway is provided in post 24 so that wire 51 can be passed through post 24 to establish a circuit connection between motor 34 and battery 36. In FIG. 6, in which casings 22 and 48 have a spherical shape, two equally sized batteries 36 are shown situated in series, while in FIG. 7 a single larger battery is used. The size of casing 48 in FIG. 7 can be larger or smaller depending upon the dimensions and type of battery 36 to be used, or, as illustrated below, more than one casing may be provided with the device which can be alternatively used as desired. Sleeve or barrier 52 is also provided around batteries 36 to prevent direct contact with the casing as discussed below.

Casings 22 and 48, post 24, and ball or stud 26 are preferably made from surgical steel, but could also be made from other materials, such as plastic, rubber, chrome plated brass or other metal. Vibratory mechanism 34 is preferably a flat coreless or coin type vibration DC motor such as, for example, a two-coil vibrational motor having a diameter of 10 mm. manufactured by Infortron Co. Ltd. of Seoul, Korea, or a three-coil vibrational motor having a diameter of 8 mm. manufactured by Fujikura of Japan. Such motors are typically used in pagers, portable telephones, watches, and other electronic devices. The Fujikara 8 mm. three-coil motor is particularly preferred for use with the invention because such motor 34 is manufactured with a waterproof coating or cover surrounding essentially the entire motor. One problem repeatedly encountered in the design and manufacture of vibrating jewelry devices is that it is difficult to prevent moisture from seeping into the casing in which the motor and/or battery are contained. If moisture comes into contact with the motor, such motor will inevitably be damaged and eventually be rendered unusable, so that the entire vibrating jewelry device may have to be replaced. The provision of a motor having a waterproof covering is therefore desirable, particularly when the motor is placed in a separate casing from battery 36, which battery is replaceable, so that even if moisture accidentally passes into the battery casing, the motor will not be ruined. It should be understood, however, that while the Fujikura motor has been mentioned as a preferred motor because it is manufactured with a waterproof outer covering or casing, other motors not having a waterproof covering could be placed in such a waterproof sleeve or covering prior to insertion into the casing 22 of the vibrating jewelry device of the invention and still achieve a similar result. In any event, it is believed that casing 22 is sufficiently moisture resistant under normal use conditions if the threaded sections of the casing are properly tightened. However, it should be evident that the addition of a waterproof casing gives the user added protection should the threads holding the sections of the casing together be accidentally left slightly loose during use in a wet environment. Batteries 36 may also be placed in a plastic or paper sleeve or covering. For example, in FIG. 6, in which two batteries 36 are shown situated in series, sleeve or barrier 52 is provided around such batteries. Such barrier 52 is also important to the proper functioning of device 20, since barrier 52 prevents the batteries from contacting the casing 48, which might cause a short in the device.

Three-coil flat coreless coin type vibration motors have several advantages over older two-coil vibration motors when used with the device of the invention. First, three-coil vibration motors produce more powerful or greater vibrations than two-coil motors, so that use of such motors in the inventor's vibrating jewelry device significantly improves its performance. In addition, while a stronger vibration is generated, three-coil motors can operate using a lower nominal current consumption value than two-coil motors, so that less power is required to operate the motor, which increases the operational life span of the power source, usually a battery. Also, by adding a magnetic pin to the motor, torque in a three-coil motor may be generated continuously, regardless of the position of the commutator in relation to the coils. Such motors are also less noisy and smaller than most other vibration motors.

The use of an 8 mm. coin type motor such as the Fujikura three-coil motor or other 8 mm. or smaller coin type motors also allows casing 22 to be made even smaller. As shown in FIGS. 6-10, this also allows casing 22 to be spherically shaped, which shape, as indicated previously, is preferred by many users of tongue-engageable jewelry devices due to its comfort, but with the qualification that the sphere or ball not be so large or bulky as to be uncomfortable or heavy in the mouth. A pulsating coin-type motor such as made by Matsushita of Japan is also a preferred motor for use with the present invention, since it is provided in several versions having variable vibrating modes, such as alternating between fast and slow vibrations, or vibrations occurring on one side of the casing and then the other, or skipping vibrations. Such motor would enable users to choose the vibration pattern that is most suited or preferred. Other types of motors, such as a cylindrical unbalanced weight motor, piezoelectric, reciprocating, or even ultrasonic may also potentially be used with the invention.

Motor 34 is also preferably a 3.0 volt motor, which motors are capable of vibration speeds up to 30,000 rpm, but have a nominal speed of 8,000-12,000 rpm, which is sufficient in the present vibrating jewelry device. A minimum voltage of 1.5 volts from battery 36 is generally required to vibrate or operate such motor. Battery 36 can be a small watch, pager or cellular phone battery. Through much trial and error, however, the inventor has discovered that only certain of such batteries can maintain at least a 1.5 volt output for a long enough time period to produce an acceptably long run time, since most of such batteries have relatively sharp discharge characteristics so that the voltage output drops under 1.5 volts rather quickly. The present inventor has found that silver oxide Energizer® brand watch or pager type batteries, manufactured by Eveready Battery Company, Inc. of St. Louis, Mo., which maintain a 1.5 volt output for a significantly longer period than other batteries tested, are best suited for use with the device of the invention. Such batteries are designed for use under continuous low drain conditions and have a relatively flat discharge characteristic or profile, so that the voltage is maintained for more or less constant current to discharge and as a result the current available remains at a constant level until the current is essentially completely exhausted. Three of such silver oxide batteries in particular have been found to be suitable, although all Energizer® silver oxide watch, pager, cellular phone or similar batteries having a constant discharge rate are presumably suitable. Either a single Energizer® battery number 393, which is 5.4 mm. thick, may be used with the 8 mm coin type motors, or two Energizer® batteries numbered 394 or 397, which are both 2.7 mm thick, are suitable for use with the 10 mm motors. The above motors are merely exemplary, and it should be obvious that other motor and battery combinations may be used with the invention.

The inventor has also found that the standard vibration speed of motor 34 can be reduced to a degree without effecting its desirability when used with the jewelry device of the invention. In particular, the inventor has found that the voltage of motor 34 can be slightly increased, from 3.0 volts to approximately 3.3 volts. This may be done quite simply as in known to those skilled in the art by increasing the resistance in the circuit of such motor, such as by adding a resistor or adding a coil to the motor. Such voltage increase causes motor 34 to vibrate slightly slower than it would otherwise vibrate, preferably causing an approximately 1,000 rpm drop, or preferably in the range of 5-15% decrease in vibration speed. However, the slightly slower vibration speed is barely noticeable by the average user, if it is noticeable at all. The detection of fine differences in vibrational frequency while detectable by the fingers, which are provided with relatively sensitive nerves, have unexpectedly been found not to be readily detectable by the nerves in the tongue which have less need for fine discriminations in vibratory discrimination. While it is well known to adjust the voltage or resistance in a motor or circuit, the inventor has found through experimentation that a battery and motor assembly including both a reduction in vibration speed of the motor 34 by increasing the voltage such as from 3.0 to 3.3 volts, in combination with the use of a silver oxide battery such as the Energizer® 394, 395, or 397 batteries having a flat discharge characteristic, results in a vibrating jewelry device 20 having an absolute vibration time that is significantly longer than that of other vibrating jewelry devices, in some cases by about 20-25%. In other words, the inventor has now produced a vibrating jewelry device which uses less current than prior designs but which runs significantly longer. Additional disclosure of this improvement is provided hereinafter with respect to FIGS. 30 and 31.

Figure 8:
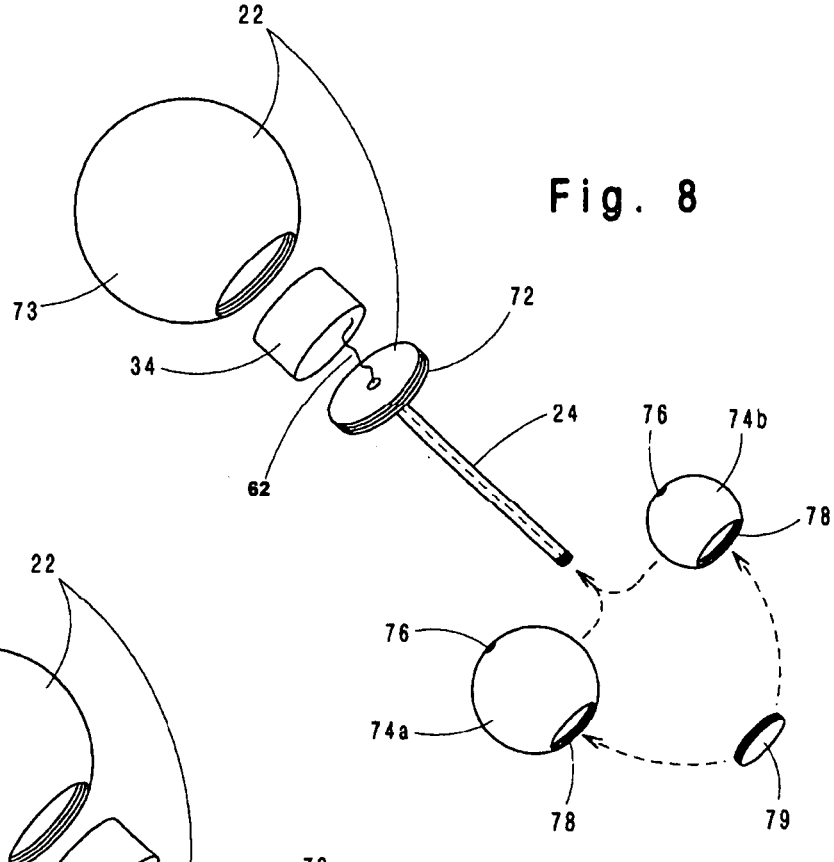
FIG. 8 is an exploded view of one embodiment of the invention illustrating the use of alternative battery casings.
Figure 9:
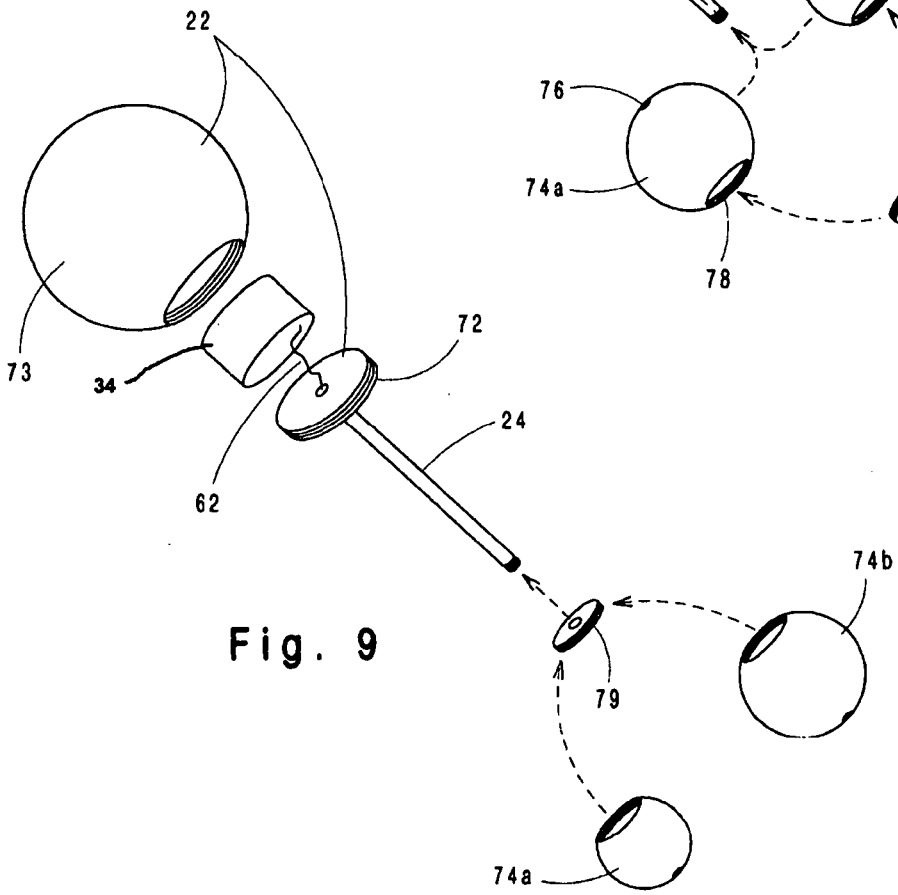
FIG. 9 is an exploded view of another embodiment of the invention wherein the cap portion of the battery casings is reversed from the embodiment shown in FIG. 8.
Figure 10:
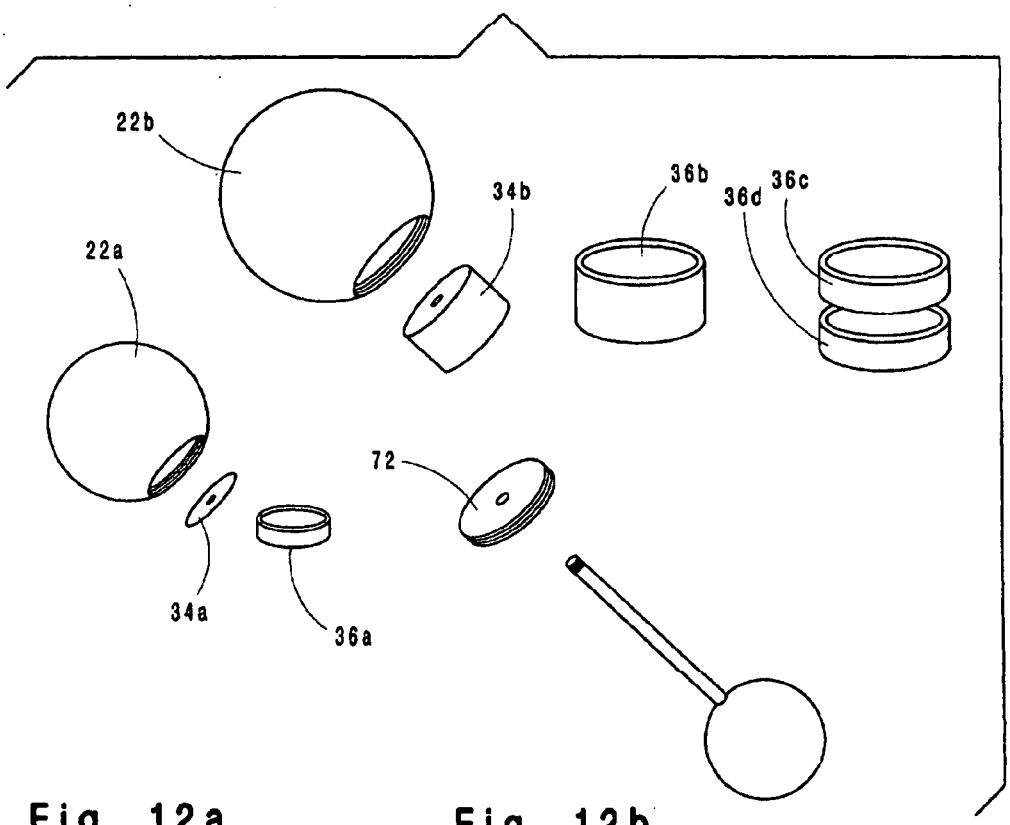
FIG. 10 is an exploded view of another alternative embodiment of the invention illustrating several possible alternative battery arrangements.

FIGS. 8-10 show exploded views of slightly alternative embodiments of the vibrating jewelry device of the invention. In FIG. 8, motor 34, which is secured in spherical casing 22, is connected to positive connection wire 62 running through post 24. In addition, cap portion 72 of casing 22, which in such FIGS. is threadably securable to main body portion 73 of casing 22, is attached to the other side of post 24. A basic difference between the embodiments shown in FIGS. 8-10 and the previous embodiments is that, rather than casing 22 being divided into two more or less equally sized sections, in FIGS. 8-10 cap 72 is just large enough to allow motor 34 to be inserted in the main body portion 73 of casing 22, so that only a single casing section is provided, rather than two separate casing sections. Another improvement is that two, rather than one, battery casings are alternatively provided with the device, such casing having different sizes. First and second battery casings 74*a* and 74*b* are alternatively detachably securable to the opposite end of post 24 having male threads which are matingly secured in threaded orifice 76 in such battery casings. Depending on which battery casing 74*a* and 74*b* is being used, cap 79 is then threadably secured to such casing. Either smaller casing 74*a* or larger casing 74*b* may be used depending upon the size or number of batteries to be used. The embodiment shown in FIG. 9 is closely similar to the embodiment shown in FIG. 8 except that in FIG. 9 post 24 is threadably secured to the outer side of cap 79 rather than into orifice 76 in casing 74*a* or 74*b* as in FIG. 8. Otherwise, cap 79 is secured to either casing 74*a* or 74*b* in the same manner shown in FIG. 8. In other words, such arrangement shown in FIG. 9 essentially moves threaded orifice 76 in FIG. 8 from a position on casing 74*a* or 74*b* to a position on cap 79. FIG. 10, which is similar to FIG. 9 except additionally showing several different sized batteries 34, further illustrates that the user has the choice of which casing to use, depending upon the size of the motor and number of batteries to be used, so that the user can control either the power or strength of the vibrations or the run time of the jewelry device.

Where motor 34 and power source or battery 36 are situated in the same casing, such as in FIGS. 1 and 29-30, it has been discovered that despite best efforts it is often difficult to establish a reliable circuit connection between motor 34 and battery 36. Therefore, after much experimentation, to address such problem the present inventor has provided a raised dome or metal dome switch 80 on the top side of motor 34. Dome switch 80 essentially extends upwardly from motor 34 and helps ensure that a reliable contact or circuit connection between the motor 34 and battery 36 is established, i.e. so that when the motor and battery are situated in the same casing side-by-side and are pressed together, dome switch 80 on motor 34 will contact battery 36 so that the motor will be activated.

Figure 11A:
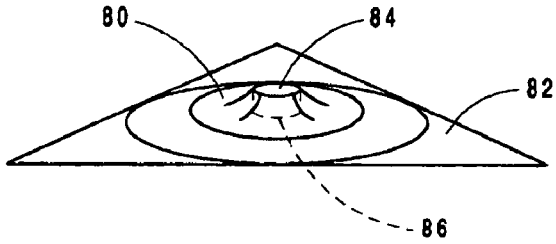
FIGS. 11*a*-11*c* illustrate the dome switch developed for use in connection with the motor assembly of the present invention.
Figure 11B:
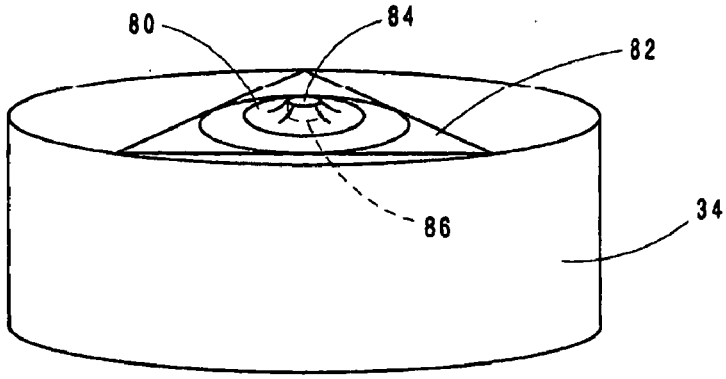
Figure 11C:
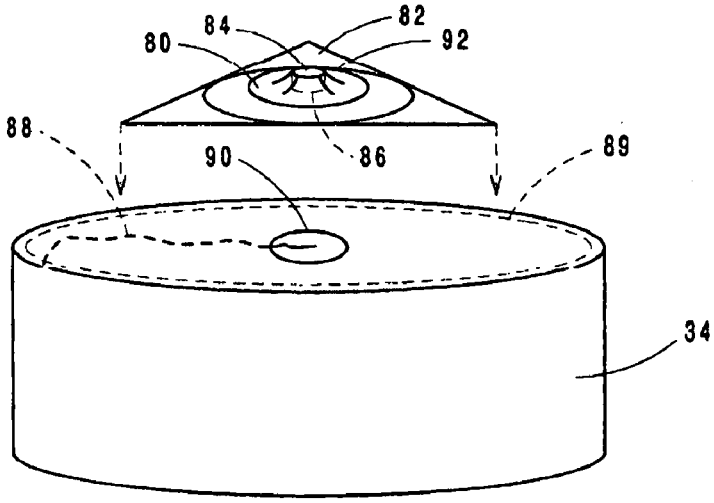

FIGS. 11*a*-11*c* illustrate dome switch 80 separate from and secured to the top surface of motor 34, respectively, while FIGS. 12*a*-12*d* illustrate dome switch 80 secured to several different types of motors. Dome switch 80 acts as a conductive spacer between motor 34 and battery 36 and, as shown in such FIGS. 11*a*-11*c* is preferably secured to the top of the motor 34 by one or more pieces of adhesive or tape 82. Tape 82 is illustrated as having a triangular shape in FIGS. 11*a*-11*c*, and is shown in dotted lines situated around the edges of the dome switch 80 in FIGS. 12*a*-12*d*. Tape 82 should be as thin as possible, and the inventor has found that an adhesive tape, such as manufactured by 3M Company, which is the thinnest adhesive tape currently known to the inventor, is suitable for use with the present invention.

Despite the use of dome switch 80, the inventor has further discovered that in some instances, tape 82 may sometimes interfere with the contact between battery 36 and dome switch 80, as the battery may sometimes also contact or rest on bunched-up tape 82 rather than solely contacting the dome switch 80. In addition, during twisting of cap 72 on casing 22, particularly when using a gripping member as explained in more detail below, the dome switch 80 and tape 82 will sometimes be pulled off of motor 34. Since the tape is typically not designed to maintain an electric current between the battery and motor, the motor may not activate correctly or remain activated in such situations. Therefore, the inventor has also provided a dimple 84 on the dome switch 80. Dimple 84 is positioned more or less centrally on the dome switch 80 extending upwardly therefrom, and should have a height great enough so that it extends above the tape 82, thereby ensuring that when battery 36 is brought into contact with switch 80, the battery will contact the dimple 84 rather than the tape 82.

Figure 12A:
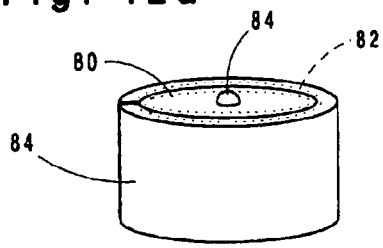
FIGS. 12*a*-12*d* are side elevation views of several vibrating motors having a dimpled dome switch thereon.
Figure 12B:
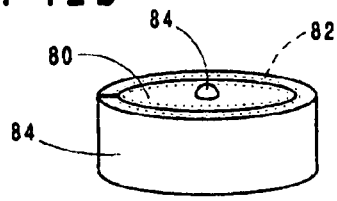
Figure 12C:
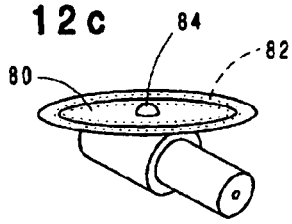
Figure 12D:
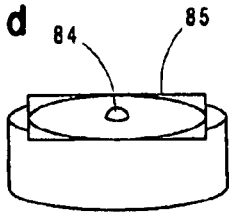

Referring still to FIGS. 11*a* and 11*b*, the center portion of dimple 84 is preferably concave or inverted, shown in dotted lines, so that a floor or bottom 86 in dimple 84 is formed. As shown in FIG. 11*c*, trace wire 88 is secured to the top of motor 34, which wire 88 is encased in a thin layer of plastic 89 extending over the top of the motor, and with dome switch 80 generally situated over or on top of plastic 89. A bare point 90 approximately 2-3 millimeters in diameter is provided generally centrally in the plastic 89 so that a contact between floor portion 86 of dimple 84 and wire 88 on motor 34 can be established when dome switch 80 is pressed downwardly against motor 34. In other words, when motor 34 is pressed against battery 36 or vice versa, first ridge portion 92 of dimple 84 will contact battery 36. As the battery and motor are further pressed together, dimple 84 will be pushed or collapse inwardly until floor portion 86 is brought into contact with trace wire 88, at which time a contact between motor 34 and battery 36 is established. The tape 82 manufactured by 3M is approximately 0.15-0.2 millimeters thick, so that dome switch 80 including dimple 84 should preferably be at least approximately 0.4 millimeters high. The inverted portion of dimple 84 should be constructed so that floor 86 is approximately 0.2-0.3 millimeters below ridge portion 92. Dimple 84 is preferably placed in dome switch 80, which is made of a thin conductive metal, using a stamping process of a type known in the prior art, although the dimple can also be manually placed in dome switch 80. In most cases, the dimple portion of the dome switch only needs to be approximately 0.2 mm in height, but, as indicated previously, in all cases should have a height greater than the width of the tape. FIG. 12*a* illustrates a motor having a diameter of 10 mm., FIG. 12*b* illustrates a three-coil motor having a diameter of 8 mm., FIG. 12*c* illustrates a cylindrical type motor situated on a PC board or chip having a dimpled dome switch thereon, and FIG. 12*d* illustrates a motor including a driver or pulse driver 85. Each of such motors has a dome switch 80 provided thereon, illustrating that such arrangement can be used whenever it is desired to situate a motor and battery side-by-side or adjacent in the same casing, or really between any two devices between which it is desirable to establish a contact.

Technological advances in micro motors driven largely by the large market for such motors as vibrational devices in cordless and cellular phones have over the last several years allowed the overall size of vibrational motors to be significantly decreased. Only recently, the smallest flat coreless vibration DC motors available at a reasonable cost had a diameter of 14 mm, or possibly 12 mm. However, as indicated above, today coreless flat motors having diameters of 10 mm and 8 mm are available, and flat motors having diameters of 6 mm and smaller are being developed. Batteries have also been continually made smaller driven by the large market for power for electronic watches and the like while maintaining much of the strength or power of their larger predecessors. Current vibratory jewelry has been able therefore to take advantage of the development of both small vibrational motors and small but powerful batteries. However, vibrational jewelry items have certain problems peculiar to these devices themselves, and it is these problems that this invention addresses. As the size of both such motors and batteries is made smaller or decreases, the size or dimensions of the casings required to hold such assembly can also be made smaller or decreased, so that is now possible to provide a much smaller vibrating jewelry device than was previously possible even a few years ago. In fact, a major drawback of prior art devices is their bulkiness or weight. However, at the same time, while the smaller devices are more comfortable when worn, the smaller devices are harder to manually grip and manipulate. One problem that has come to light is the problem of obtaining good contact between the electrical parts, i.e. the motor and batteries and this has been neatly and efficiently solved as noted above by the dimple contact noted above. Another problem is that it is much harder to adequately tighten and to loosen the threads holding the sections of the casing or a threaded cap on the casing. If such threads are not tightened properly during use, there is obviously an increased possibility of leakage occurring between the threads. In addition, in models wherein the device is activated and deactivated by turning the device on such threads, the new smaller models are considerably harder to turn off and on, again mainly because the devices are more difficult to manually grip and manipulate. On the other hand, it is still generally desirable to decrease the size of the casing as much as possible, mostly for increased comfort in the wearer's mouth. Therefore, a conflict between the goals of having the smallest and most comfortable device possible and one that is easily manipulated and activated has developed.

Figure 13:
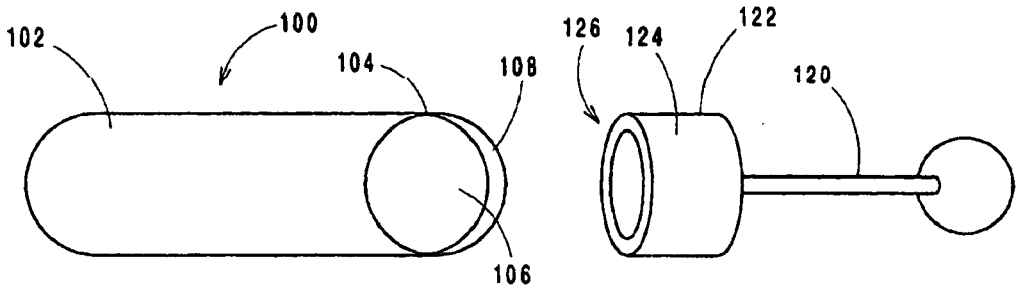
FIG. 13 is an oblique side view of the vibrating body jewelry device of the present invention in combination with a gripping member about to be used to facilitate tightening or threadably turning of the casing cap.

The present inventor has ingeniously conceived of a gripping member which facilitates gripping and activating or deactivating the vibrating body jewelry device of the invention. Such gripping member is primarily to be used when the threads holding the cap portion of the casing to the main body portion must be tightened or loosened. However, the gripping member can also be used at any time it is required to grip or hold the vibrating body jewelry device. FIG. 13 illustrates one embodiment of such a gripping member, indicated generally by the reference numeral 100, and shown aligned with vibrating jewelry device 120. Casing 122 of device 120 is generally cylindrical in shape and is comprised of a main body portion 124 and a cap portion 126 which is threadably secured on the outer end of the main body portion 124. Gripping member 100 is generally comprised of an elongated handle or grasping portion 102, shown in FIG. 13 as having a cylindrical form, but which could also be provided in other shapes or contoured to fit the shape of one's hand as in FIG. 14, and a cap gripping portion 104. Cap gripping portion 104 is also generally cylindrical in shape, but in general should mimic the shape of the outer surface of cap 126. Gripping portion 104 preferably has a hollowed out central or interior portion 106 surrounded by side walls 108. The inner diameter of side walls 108 of cap gripping portion 104 should be just slightly less than the greatest outer diameter of cap 126, so that when the gripping portion 104 of gripping member 100 is fitted over cap 126, side walls 108 will be pressed tightly against the outer sides of cap 126. The side walls 108 of gripping portion 104 thereby frictionally grip the outer surface of cap 126 so that it can be more easily held, turned, or otherwise manipulated by a user or wearer. Such gripping action is also known as a taper lock, wherein the tapered cone or gripping portion of the gripping member 100 is essentially form or press fitted to the outer surface of cap 126 thereby interlocking the gripping member and cap.

Figure 14:
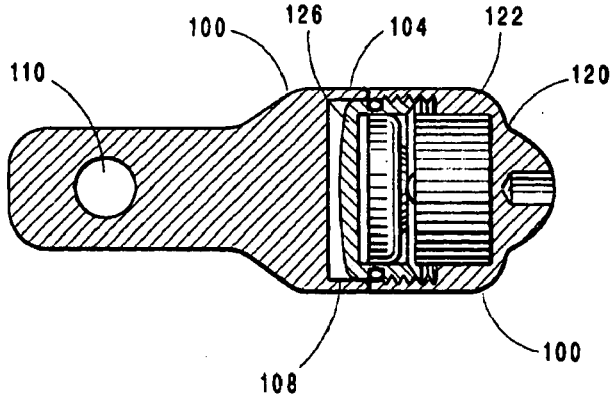
FIG. 14 is a sectional side view of a slightly modified gripping member in attachment position with respect to the cap portion of the casing of the vibrating body jewelry device of the invention.

FIG. 14 is a sectional view of a gripping member 100, and casing 122, the gripping member having a slightly different handle design, including orifice 110 provided in handle portion 102 so that it can be attached to and carried on a key ring or the like. In FIG. 14, gripping member 100 is shown secured to or gripping cap portion 126 of casing 122. As also evidenced in FIG. 14, it is not necessary, or even desired, that gripping member 100 contact the entire outer surface of cap 126. Although this would be possible, it has been found that the frictional grip or taper lock on the sides of the cap is sufficient to grip and turn cap 126. In other words, gripping portion 104 does not have to fit tightly against or even contact the entire top of cap 126, but rather only the sides of such cap via side walls 108.

The use of gripping member 100 also enables the threads securing cap 126 to main body section 124 of casing 122 to have tighter tolerances, so that the distance between such individual threads is reduced. Reducing the distance between the individual threads is advantageous because it reduces the risk of liquids seeping between such threads by reducing the play or room between the threads. However, it should also be obvious that tightening or decreasing the tolerances of the threads also makes such threads harder to tighten and loosen. In combining threads having a tighter tolerance with the overall decreased size of casing 122 due to the use of smaller component parts, it quickly becomes more difficult to manually turn cap 126 in relation to main body section 124 in relation to each other on the threads, either to activate or de-activate the motor or simply to open the casing to replace the battery or perform other maintenance. However, the use of gripping member 100, although not mandatory, makes such design essentially operative by the average user and therefore much more desirable. Gripping member 100 can also be used to open and close a snap-on type cap rather than a threaded cap, wherein after the gripping member is placed on cap 126, the gripping member is pivoted until cap 126 snaps off of main casing section 124.

Figure 15:
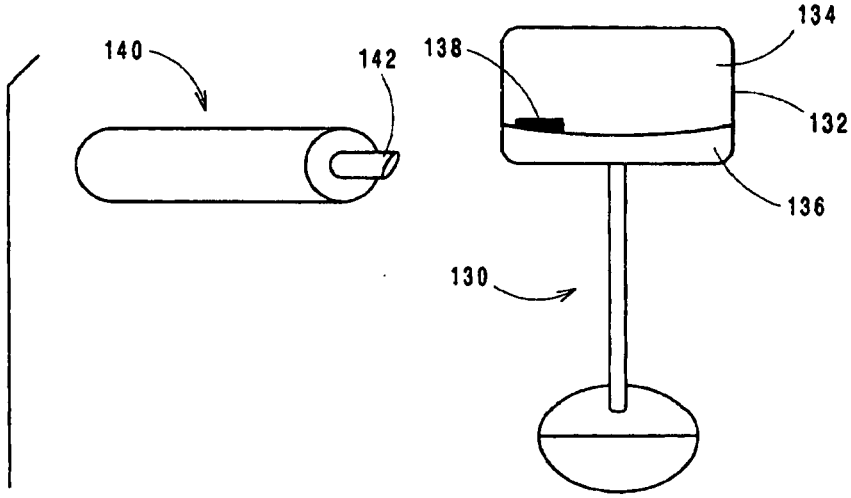
FIG. 15 illustrates another embodiment of the invention wherein the casing has a snap-off or notched top and showing a tool used to facilitate removal of the top.

While FIGS. 13-14 illustrate how gripping member 100 may be used to removed a generally flat or oval cap 126 from the main body portion 124 of casing 122, FIG. 15 shows a jewelry device 130 having a slot or notch 138 situated along the connection line between casing sections 134 and 136. In addition, gripping member 140 has been modified so that it has a tip 142 which can be fitted or wedged into slot 138 and then used to pry the sections 134 and 136 of casing 132 apart. Cap 126 could also be notched, slotted, tabbed or the like to facilitate threading of such cap to main housing portion 124. For the convenience of the user, jewelry device 120 will preferably be sold in combination with such suitable gripping member. FIG. 16 illustrates gripping member 100 as it may be used to grip the surface of the cap 146 of a spherical housing 142, with the arrows indicating the relative rotation of gripping member 100, main body portion 144 and cap 146 of casing 142. FIG. 17 illustrates another alternative embodiment wherein the motor 34 having dome switch 80 is situated side-by-side in casing 122 with battery 36 and utilizing gripping member 100 to tighten and loosen cap 126 from main body portion 124.

FIG. 18 illustrates another alternative design for a gripping member 200, similar to gripping member 100 in FIG. 13, but wherein the handle portion 202 also serves as a storage compartment for holding extra batteries 236 as well as for storing the vibrating jewelry device 220 of the invention when it is not in use. In addition, a second larger casing section or cap 240 is also be provided so that, as previously shown and described with reference to FIGS. 8-10, larger or multiple numbers of batteries can be used with the device. In FIG. 18, handle portion 202 is more or less completely hollow, and sleeve 210, preferably a thin hollow plastic sleeve, is dimensioned so that it can be inserted into the handle portion 202, with batteries 236 placed in the sleeve rather than being placed directly into the handle portion. Sleeve 210 essentially prevents the batteries 236 from touching the side walls of handle portion 202, which contact with the side walls might create a circuit through such handle, eventually causing the batteries to short out or become drained or damaged. Cap gripping portion 204 of gripping member 200 is closed off by the casing 222 of device 220, which is frictionally fitted against side walls 208 of gripping portion 204, while the other end is closed off by replacement cap 240 being threadably secured on such end. While gripping portion 204 is designed to grip the sides of casing 222, it is also designed to accommodate the ball and post assembly 224 and 226 of the device for storage or transport of the device when it is not in use, with the device 220 being inserted into gripping member 202 in an inverted position as shown in FIG. 18. Band 300, which can be alternatively used to secure the device to a non-pierced area of the body and described in more detail below, may also be secured in gripping member 200 and provided as part of the kit or package. Directions for use 298 will also be provided.

The main advantage of the embodiment shown in FIG. 18 is that it essentially provides the user with everything required to utilize the invention in a single kit or package, including the jewelry device 220, extra batteries 236, gripping member 200, replacement cap 240, instructions 298, and ring 300. Providing all of such articles packaged together is attractive and convenient to the user, enabling him or her to use either a single small or large battery or two small batteries with the jewelry device without having to purchase extra supplies separately at the time of purchase. The user can then double the speed of the motor 234 by positioning two smaller batteries 236 in series, or can use a single larger battery, wherein the run time of the motor is doubled. Secondary cap 240 is readily threaded to casing 222 so that it is essentially interchangeable with the standard cap. Such extra cap provides the user with additional alternatives not available in prior art devices known to the inventor.

Figure 19:
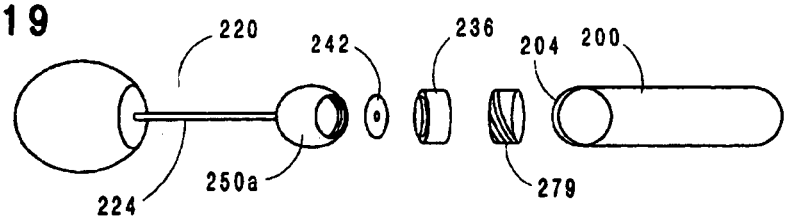
FIG. 19 is a partially exploded view illustrating another possible arrangement of the body jewelry device of the invention.
Figure 20:
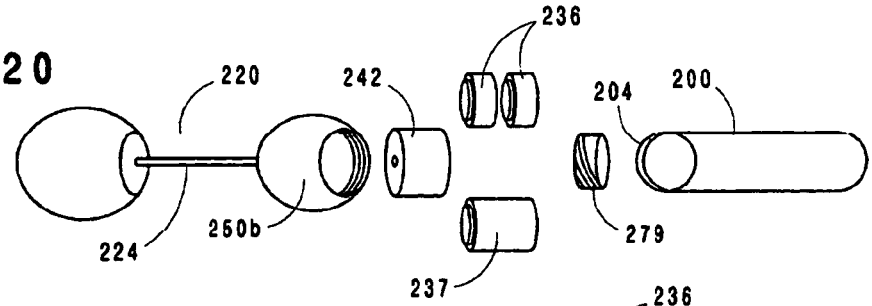
FIG. 20 is another partially exploded view similar to FIG. 19 showing another possible assembly arrangement of the body jewelry device of the invention.
Figure 21:
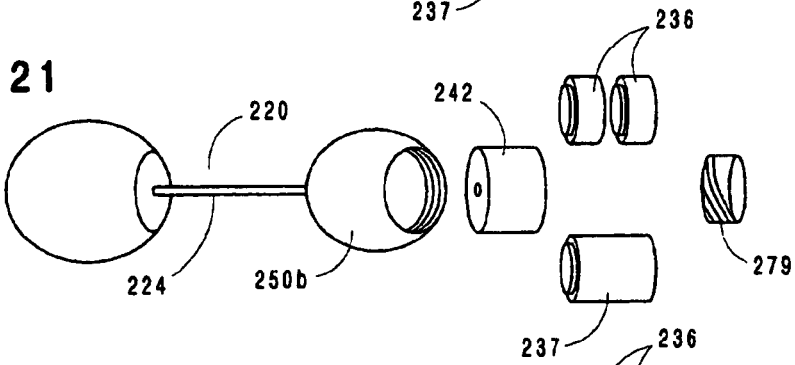
FIG. 21 is a further partially exploded view similar to FIG. 20 showing another possible arrangement of the body jewelry device of the invention.
Figure 22:
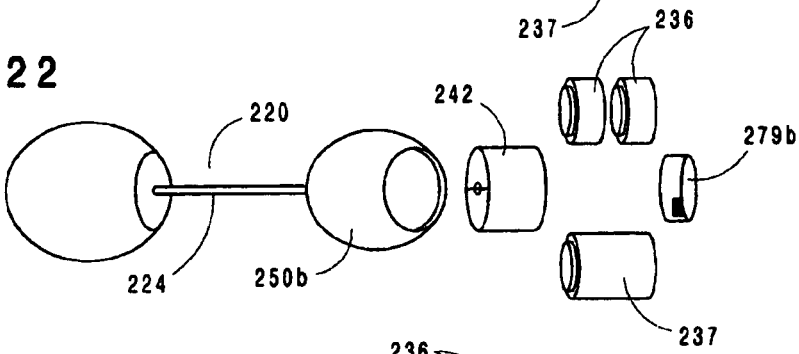
FIG. 22 illustrates a still further possible arrangement of the invention similar to FIG. 21 having a notched casing cap.
Figure 23:
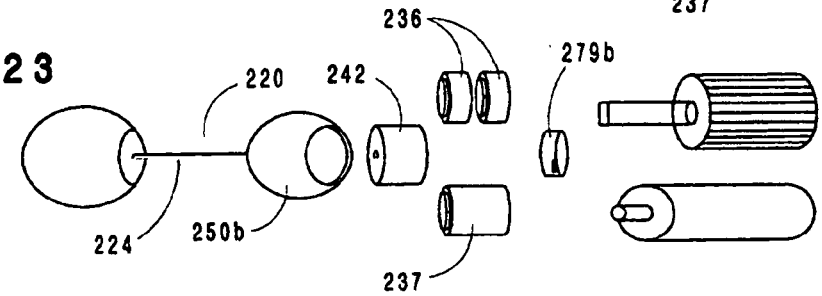
FIG. 23 illustrates a still further possible arrangement of the invention similar to FIG. 22 including means for removing the notched casing cap.

FIGS. 19-24 are several additional exploded views of the vibrating jewelry device 220, which FIGS. are included to further illustrate the many different ways or arrangements in which such device can be provided. FIG. 19 illustrates a basic arrangement wherein a single battery 236 is inserted in casing 250*a* along with insert 242, which is provided to prevent battery 236 from contacting casing 250*a*, which might cause a short in the battery. Cap 279 is then secured or tightened on casing 250*a* using gripping member 200. FIG. 20 shows larger replacement cap 250*b* being used in place of regular cap 250*a*. Such arrangement enables either two smaller batteries 236 or one larger battery 237 to be placed in casing 250*b*, thereby increasing either the power or vibrating time of the motor. Note that the same cap 279 is preferably used with both smaller and larger casings 250*a* and 250*b* so that the same gripping member 200 can also be used. Insert 242 in FIG. 20 comprises a sleeve to encase both batteries 236 so that neither can contact the sides of casing 250*b*. FIG. 21 is similar to FIG. 19 except that gripping member 200 is not shown. This is meant to illustrate that while the use of gripping member 200 is preferred, cap 279 may be secured to casing 250*b* without using such member, although it may be more difficult to grasp in one's hand. FIG. 22 illustrates the device having a notched cap 279*b*, while FIG. 23 illustrates the device as shown in FIG. 22 with gripping members having tips to fit such notch.

In an another embodiment, an insert 260, shown in FIG. 24, is provided for use in combination with the gripping member 200. Insert 260 has a first threaded portion 262 on one end which is adapted to be threadably secured to the casing 250*a* or 250*b*, and wherein the other end 264 of the insert is threadably securable to the end of the gripping member 200 in place of replacement cap 240. Insert 260 allows the jewelry device to be connected to various other devices, such as a battery pack 280 as shown in FIG. 25 so that the vibrating jewelry device can be used as a vibrating wand.

Thusfar, the post portion of the device has been shown and described as being threadably secured on one or both ends to casings for holding the mechanical or electrical parts of the vibrating motor assembly or to a ball or stud threadably secured on one end. However, various items can be substituted for ball 26 or even post 24, mainly so that the device can also be secured to unpierced body parts or the like. For example, in FIG. 26, such post has been omitted so that casing 322 is threadably secured on one end directly into threaded portion or nub 302 of band 300. Band 300 may be provided in various sizes and may be made of either a rigid material such as plastic or metal, or alternatively of an elastic material much like a synthetic rubber band which band can be elastically fitted around an unpierced portion of the body, such as on a finger, arm, or sexual organ. Synthetic rubber is preferred so as to prevent any possible allergic reaction. Nub 302 is preferably pressed through the band and secured in a rivet-like fashion, but may be secured by any suitable means and may have a length so that it is equivalent to a shortened post. In another embodiment, band 300 may include a means for adjusting the size of the band, so that it can be adjusted to fit a wider range or size of appendages. Such embodiment is particularly desirable in rigid rather than elastic bands. In FIG. 27, gripping member 100 is shown positioned above the banded jewelry device, illustrating that the banding alternative can be provided with the same types of devices described in detail above, and which band is included in the kit shown in FIG. 18.

FIG. 28 illustrates yet another alternative embodiment of the invention wherein battery 36 is inverted or positioned upside down in relation to motor 34 so that top 37 is pointing upwardly. The inverted battery arrangement may be utilized essentially to enable casing 22 to have a slightly more spherical or rounded shape at least on the top area of the casing, which as indicated previously is more generally comfortable to wear on the tongue than some of the other designs and is slightly less bulky. The circuit connection for such arrangement has already been shown, but generally a contact point or wire 39 extending from the top 37 of battery 36 downwardly along the side of the battery to the motor 34 is provided to compensate for such inverted arrangement.

FIG. 29 is a diagrammatic representation of the previous vibrating jewelry devices 20 including a vibrating motor 34 and a regular battery 36 positioned on top of the motor together with two charts indicating respectively typical battery discharge characteristics with either current or voltage plotted against the ordinate and time along the abscissa in curve (a) plus an operating curve for a device such as the motor 34 plotted in curve (b) with speed plotted along the ordinate and time again plotted along the abscissa.

FIG. 30 is a view of a basic embodiment of the invention having an 8 mm. motor 34 having a dome switch 80 slowed as described above by additional resistance via resistor 87 and including a battery 36 having a flat discharge characteristic, such as a silver-oxide Energizer® or equivalent battery. Charts (a) and (b) of the discharge of the flat discharge battery and an operating curve of the device respectively are included. In each case as in FIG. 29 time is plotted along the abscissa.

Figure 31A:
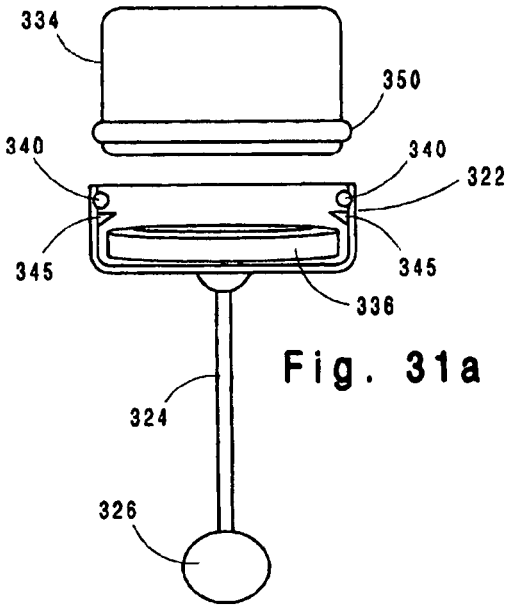
FIGS. 31*a*-31*d* illustrate cross sectional views of still other alternative embodiments of the invention in which the casing extends only part way about the vibratory motor and the motor may be activated by pressing inwardly against the battery and may be deactivated by wedging away from the battery by wedging extensions extending between the battery and motor from the side of the casing.
Figure 31B:
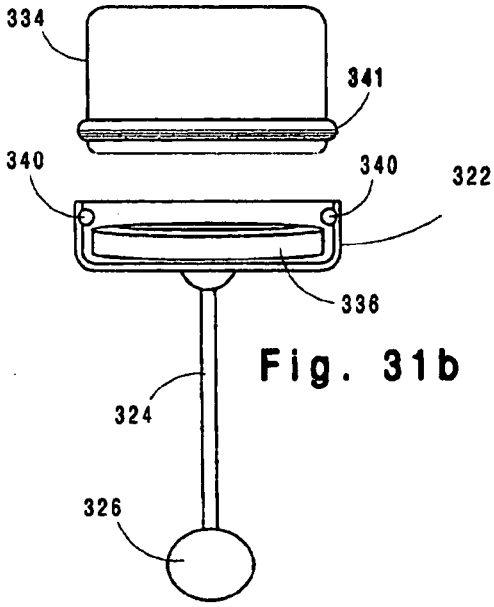
Figure 31C:
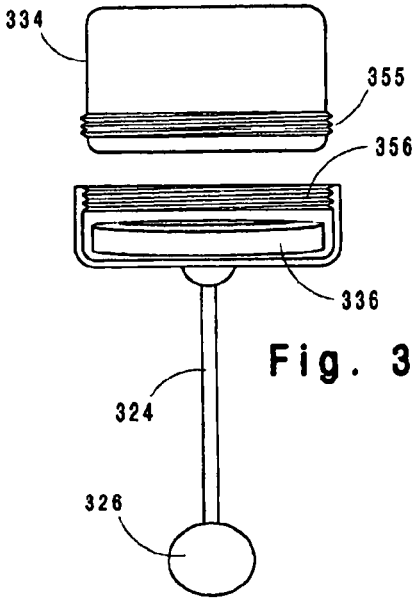
Figure 31D:
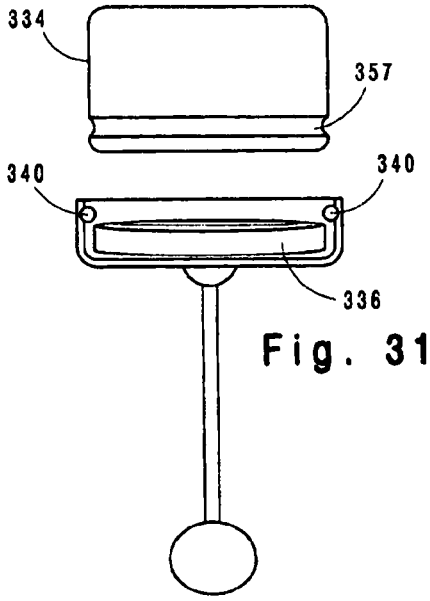
Figure 32:
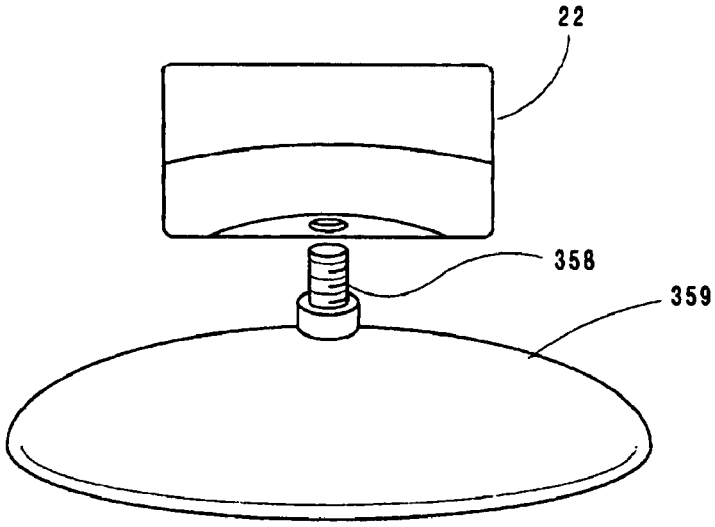
FIG. 32 is a cross sectional exploded view of another embodiment, in which a suction cup is utilized in place of a band to attach the vibratory device to a unpierced tongue or unpierced part of the body.
Figure 33:
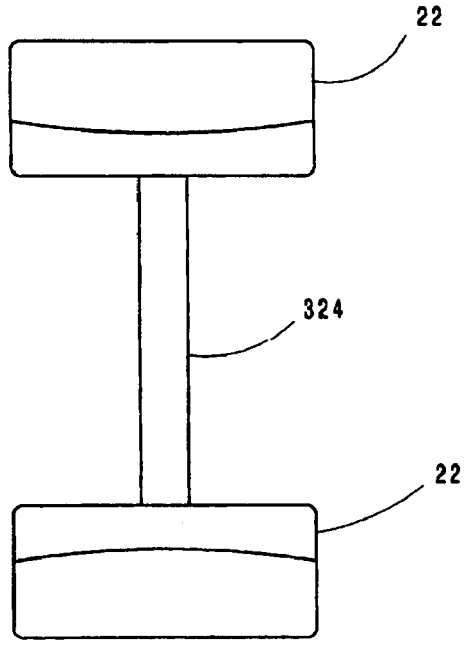
FIG. 33 is a cross sectional view of still another embodiment in which there are two vibrating devices, one placed at the both ends of the post, in order to provide more stimulation to the user.

FIGS. 31*a*-31*d* illustrate another alternative embodiment of the invention making use of a completely enclosed sealed vibrating motor 334 in which the motor is positioned on top and is only half within the bottom casing 322 of the vibrating jewelry device. Since the motor is completely sealed, it is acceptable for it to be exposed to the environment of the mouth. A gasket 340 along the side prevents saliva and other moisture from getting inside the casing. Since the motor protrudes from the casing, it can be activated by merely pressing such motor down upon the battery, the tightness of the side gasketing maintaining the motor against the battery. When it is desired to stop the motor, the sides of the casing can be pressed, which will force the tapered extensions 345 between the battery and the motor forcing the motor to move slightly upwardly and breaking contact between the battery and motor. In FIG. 31*a*, an outward dimpling 350 is provided along the bottom periphery of the motor casing 334, which fits under the gasket 340 on the bottom casing 322. In FIG. 31*b*, the outward dimpling 350 on the motor casing is replaced with a second gasket 341 situated around the lower periphery of such casing. In addition, the gasket 340 on the bottom casing may also be an inwardly facing dimple rather than the gasket shown. In FIG. 31*c*, threads 355 are provided on the outer lower periphery of motor casing 324, which threads allow the motor casing to be threaded directly onto threads 356 on the lower casing section, so that a tight fit between the device and the motor is threadably formed. In such case, the motor can be activated directly by rotation so it can be brought tightly up against battery. Finally, in FIG. 31*d*, an inward dimple 357 is provided on the lower periphery of the motor casing 324, with gasket 340 positioned on the lower casing. When the motor is pressed inwardly the gasket or dimple on the casing snaps into the inward groove or dimple on the lower radius of the motor. In addition, a straight motor may be used relying upon a tight gasket interfit with the gasket around the inner edge of the casing to hold the motor securely. It is preferred, however, some form of interlocking or interfitting as shown in FIGS. 31*a* through 31*d* for security to prevent a small motor from detaching from the casing in the mouth and possibly becoming lost or irretrievable in the wearer's alimentary canal. FIG. 32 is another example of attaching the vibrating device to the body by means of suction, attaching vibrator housing 22 to post 358 embedded into a suction cup 359, the unit is then present against a body part. FIG. 33 is a means of attaching a second vibrating device 22 onto the lower portion of post 324 in place of a retainer ball and is preferable because it allows the user the double vibration.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A vibratory body jewelry device comprising:

(a) a two section casing, said first section being threadably securable to said second section;

(b) a vibratory motor;

(c) a power source for providing power to the motor, said motor and power source being housed in said casing;

(d) a gripping member detachably securable to one of said casing sections to facilitate manual gripping of and rotating said sections relative to one another wherein said gripping member is comprised of a gripping portion integral with a handle portion, said gripping portion being dimensioned to frictionally grip at least a portion of the outer surface of said casing; and (e) means for securing the casing to the body of a human.

2. The vibratory body jewelry device of claim 1 wherein the first and second sections of the casing are comprised of a main body portion and a cap portion threadably securable to the main body portion.

3. The vibratory body jewelry device of claim 2 wherein the motor is activated and deactivated by tightening and loosening said cap portion on said main body portion, thereby completing or breaking an electric circuit between the motor and power source.

4. The vibratory body jewelry device of claim 3 wherein tightening and loosening of the threaded cap portion using said gripping member serves as the actuating means for activating said vibratory motor and battery assembly.

5. The vibratory body jewelry device of claim 4 wherein the threads securing the cap portion of the casing to the main body portion of the casing have a tighter tolerance than would be possible without the use of said gripping member to facilitate manual turning of said cap portion on the threads.

6. The vibratory body jewelry device of claim 1 wherein said means for securing the casing to the body includes a post having two ends, said post being attached to one of said casing sections on one end and having a stud detachably secured to its other end to hold the device with the post extending through a pierced area of the body.

7. The vibratory body jewelry device of claim 6 wherein said stud is replaced by a second casing for holding said power source, and wherein a circuit is provided through said post connecting the motor and power source.

8. The vibratory body jewelry device of claim 7 wherein said power source is a battery, and wherein a plurality of casings of different sizes encasing one or more batteries can be interchangeably secured to the post.

9. The vibratory body jewelry device of claim 1 wherein said means for securing the casing to the body comprises an elastic band connected to the casing.

10. The vibratory body jewelry device of claim 1 wherein the motor and power source are situated side-by-side in said casing, and wherein said motor additionally comprises a dome switch assembly secured to the side of the motor facing the power source.

11. The vibratory body jewelry device of claim 10 wherein said dome switch is adhesively secured to the motor.

12. The vibratory body jewelry device of claim 11 wherein the height of the dome switch is greater than the thickness of the adhesive.

13. The vibratory body jewelry device of claim 10 wherein the dome switch additionally includes a dimpled portion centrally located on said dome switch.

14. The vibratory body jewelry device of claim 13 wherein said dimple includes a concave center portion and a ridge portion surrounding said center portion arranged so that the center portion is pressed into contact with an electrical contact secured to the motor when the ridge portion of the dimple contacts and is urged inwardly when brought into contact with the power source.

15. The vibratory body jewelry device of claim 1 wherein said gripping portion frictionally grips said casing by means of a taper lock arrangement.

16. The vibratory body jewelry device of claim 1 wherein said gripping portion is generally arcuately shaped and includes side walls spaced around a hollowed out central portion, the diameter of said hollowed out central portion being slightly less than the diameter of the outer surface of said cap portion so that the side walls will frictionally grip the cap portion along its outer surface.

17. A vibrating jewelry apparatus for use on the surface of the body comprising:

(a) a casing;

(b) a battery in such casing;

(c) a vibrating motor completely encapsulated in its own waterproof outer covering;

(d) means for attaching the jewelry casing to the human body;

(e) the vibratory motor being partially contained in the jewelry casing with at least a portion extending from the casing but with its electrical contacts in the casing and the edges of the casing closely encompassing the side of the motor in a substantially liquid impassible relationship, (f) the motor being movable toward the battery to effect electrical contact between the two by normal pressure of the motor; and (g) means for moving the motor and the battery apart to break contact between them.

18. A vibratory jewelry apparatus for use on the surface of the body in accordance with claim 17 wherein the means to move the motor and battery apart is comprised of wedge action separator elements movable laterally between the motor and battery to wedge the two apart.

19. A vibratory jewelry apparatus for use on the surface of the body in accordance with claim 18 wherein the wedge action separator elements are mounted on the interior of the casing and the casing is of a gauge so that pressure on the sides of the casing moves the wedge action separator elements inwardly wedging apart the vibratory motor and battery to break electrical contact between them.

20. A vibratory body jewelry device comprising:

a. a two section casing;

b. a vibratory motor;

c. a power source for providing power to the motor, said motor and power source being in said casing;

d. a gripping member detachably securable one section of said casing for rotating said section relative to the other section;

e. means for securing the casing to the body of a human;

f. wherein the motor and power source are situated side-by-side in said casing, and wherein said motor additionally comprises a dome switch assembly secured to the side of the motor facing the power source, said dome switch adhesively secured to the motor.

21. The vibratory body jewelry device of claim 20 wherein the two sections of the casing are comprised of a main body portion and a cap portion threadably securable to the main body portion.

22. The vibratory body jewelry device of claim 21 wherein the motor is activated and deactivated by tightening and loosening said cap portion on said main body portion, thereby completing or breaking an electric circuit between the motor and power source.

23. The vibratory body jewelry device of claim 22 wherein tightening and loosening of the threaded cap portion using said gripping member serves as the actuating means for activating said vibratory motor and battery assembly.

24. The vibratory body jewelry device of claim 23 wherein the threads used to attach the cap portion to the main body portion of the casing have a tighter tolerance than would be possible without the use of said gripping member to facilitate tightening and loosening said cap portion on the threads.

25. The vibratory body jewelry device of claim 20 wherein said means for securing the casing to the body includes a post having two ends, said post being attached to the casing on one end and having a stud detachably secured to its other end to hold the device with the post extending through a pierced area of the body.

26. The vibratory body jewelry device of claim 25 wherein said stud is replaced by a second casing for holding said power source, and wherein a circuit is provided through said post connecting the motor and power source.

27. The vibratory body jewelry device of claim 26 wherein said power source is a battery, and wherein a plurality of casings of different sizes encasing one or more batteries can be interchangeably secured to the post.

28. The vibratory body jewelry device of claim 20 wherein said means for securing the casing to the body comprises an elastic band, said elastic band being threadably secured to the casing.

29. The vibratory body jewelry device of claim 20 wherein the height of the dome switch is greater than the thickness of the adhesive.

30. The vibratory body jewelry device of claim 20 wherein the dome switch additionally includes a dimpled portion centrally located on said dome switch.

31. The vibratory body jewelry device of claim 30 wherein said dimple includes a concave center portion and a ridge portion surrounding said center portion arranged so that the center portion is pressed into contact with an electrical contact secured to the motor when the ridge portion of the dimple contacts and is urged inwardly when brought into contact with the power source.

32. The vibratory body jewelry device of claim 20 wherein said gripping member is comprised of a handle portion on one end and a gripping portion integrally secured to the handle portion on the other end, said gripping portion being dimensioned to frictionally grip at least a portion of the outer surface of the cap portion of the casing.

33. The vibratory body jewelry device of claim 32 wherein said gripping portion frictionally grips said cap by means of a taper lock arrangement.

34. The vibratory body jewelry device of claim 32 wherein said gripping portion is generally arcuately shaped and includes side walls spaced around a hollowed out central portion, the diameter of said hollowed out central portion being slightly less than the diameter of the outer surface of said cap portion so that the side walls will frictionally grip the cap portion along its outer surface.

* * * * *